US010060057B2

(12) United States Patent
Lee

(10) Patent No.: US 10,060,057 B2
(45) Date of Patent: Aug. 28, 2018

(54) BRAIDING MACHINE WITH NON-CIRCULAR GEOMETRY

(71) Applicant: NIKE, Inc., Beaverton, OR (US)

(72) Inventor: Eun Kyung Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 465 days.

(21) Appl. No.: 14/721,314

(22) Filed: May 26, 2015

(65) Prior Publication Data

US 2016/0348288 A1 Dec. 1, 2016

(51) Int. Cl.
*D04C 3/28* (2006.01)
*D04C 3/18* (2006.01)
*D04C 3/36* (2006.01)

(52) U.S. Cl.
CPC ..... *D04C 3/28* (2013.01); *D04C 3/18* (2013.01); *D04C 3/36* (2013.01)

(58) Field of Classification Search
CPC ... D04C 3/18; D04C 3/22; D04C 3/24; D04C 3/36; D04C 3/40
See application file for complete search history.

(56) References Cited

U.S. PATENT DOCUMENTS 165,941 A 7/1875 Malhere
293,020 A 2/1884 Hedtmann
329,739 A 11/1885 Henkels
376,372 A 1/1888 Dodge et al.
450,685 A * 4/1891 Struss ..... D04C 1/12 174/124 R
810,056 A 1/1906 Janssen et al.
847,005 A 3/1907 Kirberg et al.
894,022 A 7/1908 Lepperhoff et al.
920,994 A 5/1909 Prante et al.
936,356 A 10/1909 Rahm et al.
979,502 A 12/1910 Janssen et al.
1,117,330 A 11/1914 Cobb et al.
1,318,888 A 10/1919 Carpentier
1,379,478 A 5/1921 Schevitz et al.
1,527,344 A 2/1925 Bente et al.
(Continued)

FOREIGN PATENT DOCUMENTS

DE 726634 C 10/1942
DE 43 06 286 A1 9/1993
(Continued)

OTHER PUBLICATIONS

International Search Report and Written Opinion dated Nov. 14, 2016 for International Patent Application No. PCT/US2016/034104, 19 Pages.
(Continued)

*Primary Examiner* — Shaun R Hurley
(74) *Attorney, Agent, or Firm* — Shook, Hardy and Bacon L.L.P.

(57) ABSTRACT

A braiding machine in which spools wound with tensile elements are mounted on carriages that are disposed on a rotor track around the perimeter of the braiding machine. The perimeter of the braiding machine is non-circular, such that the area enclosed by the perimeter of the non-circular braiding machine is substantially less than the area enclosed by a circular braiding machine having a perimeter of the same length as the perimeter of the non-circular braiding machine.

27 Claims, 28 Drawing Sheets

(56) References Cited

U.S. PATENT DOCUMENTS 1,538,160 A 5/1925 Bosebeck et al.
1,554,325 A 9/1925 Bente et al.
1,583,273 A 5/1926 Bosebeck et al.
1,593,670 A 7/1926 Petersen et al.
1,622,021 A 3/1927 Birkin et al.
1,637,716 A 8/1927 Turck et al.
1,885,676 A * 11/1932 Blaisdell ..... D04C 1/00 87/30
1,887,643 A 11/1932 Huber et al.
2,022,350 A 11/1935 Huber et al.
2,091,215 A 8/1937 Price et al.
2,188,640 A 1/1940 Bloch et al.
2,334,399 A 11/1943 Fether et al.
2,788,700 A 4/1957 Crossley et al.
2,879,687 A * 3/1959 Leimbach ..... D04C 1/06 87/11
2,936,670 A 5/1960 Walter
2,941,440 A 6/1960 Scanlon et al.
2,960,905 A 11/1960 Scanlon et al.
3,282,757 A 11/1966 Brussee
3,397,847 A 8/1968 Thaden
3,426,804 A 2/1969 Bluck
3,521,315 A 7/1970 Chatzimikes
3,541,247 A 11/1970 Mangred et al.
3,586,058 A 6/1971 Ahrens et al.
3,714,862 A 2/1973 Berger
3,943,361 A 3/1976 Miller
4,005,873 A 2/1977 Jacobsen et al.
4,275,638 A 6/1981 DeYoung
4,312,261 A 1/1982 Florentine et al.
4,323,925 A 4/1982 Abell et al.
4,351,889 A 9/1982 Sundberg et al.
4,366,476 A 12/1982 Hicken
4,494,436 A 1/1985 Kruesi
4,519,290 A 5/1985 Inman et al.
4,591,155 A 5/1986 Adachi
4,615,256 A 10/1986 Fukuta et al.
4,719,837 A 1/1988 McConnell et al.
4,847,063 A 6/1989 Smith
4,848,745 A 7/1989 Bohannan et al.
4,857,124 A 8/1989 Shobert et al.
4,884,309 A 12/1989 Shafir et al.
4,885,973 A 12/1989 Spain
4,909,127 A * 3/1990 Skelton ..... D04C 3/22 87/21
4,916,997 A 4/1990 Spain
4,934,240 A * 6/1990 Culp, Sr. ..... D04C 3/04 87/1
4,976,812 A 12/1990 McConnell et al.
4,992,313 A 2/1991 Shobert et al.
5,001,961 A 3/1991 Spain
5,067,525 A 11/1991 Tsuzuki et al.
5,121,329 A 6/1992 Crump et al.
5,203,249 A 4/1993 Adams et al.
5,257,571 A 11/1993 Richardson
5,287,790 A 2/1994 Akiyama et al.
5,348,056 A 9/1994 Tsuzuki
5,361,674 A 11/1994 Akiyama et al.
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,601,522 A 2/1997 Piramoon et al.
5,879,725 A 3/1999 Potter
5,885,622 A 3/1999 Daley et al.
5,915,030 A 6/1999 Viebach et al.
6,024,005 A 2/2000 Uozumi
6,029,375 A 2/2000 Borel
6,345,598 B1 2/2002 Bogdanovich et al.
6,495,227 B1 12/2002 Cahuzac
6,510,961 B1 1/2003 Head et al.
6,679,152 B1 1/2004 Head et al.
6,696,001 B1 2/2004 Quddus
6,741,728 B1 5/2004 Genest
7,004,967 B2 2/2006 Chouinard et al.
7,069,935 B2 7/2006 Bousfield et al.
7,079,916 B2 7/2006 Stimpson
7,093,527 B2 8/2006 Rapaport et al.
7,204,903 B2 4/2007 Yasui
7,252,028 B2 8/2007 Bechtold et al.
7,262,353 B2 8/2007 Bartholomew et al.
7,300,014 B2 11/2007 Allen
7,444,916 B2 11/2008 Hirukawa
7,566,376 B2 7/2009 Matsuoka
7,661,170 B2 2/2010 Goode et al.
7,793,576 B2 9/2010 Head et al.
7,815,141 B2 10/2010 Uozumi et al.
7,908,956 B2 3/2011 Dow et al.
7,938,853 B2 5/2011 Chouinard et al.
8,006,601 B2 8/2011 Inazawa et al.
8,061,253 B2 11/2011 Wybrow
8,192,572 B2 6/2012 Willey et al.
8,210,086 B2 7/2012 Head et al.
8,261,648 B1 9/2012 Marchand et al.
8,347,772 B2 1/2013 Dow et al.
8,394,222 B2 3/2013 Rettig
8,511,214 B2 8/2013 Gries
8,578,534 B2 11/2013 Langvin et al.
8,651,007 B2 2/2014 Adams
8,690,962 B2 4/2014 Dignam et al.
8,757,038 B2 6/2014 Siegismund
8,770,081 B2 7/2014 David et al.
8,789,452 B1 7/2014 Janardhan et al.
8,794,118 B2 8/2014 Dow et al.
9,144,284 B2 9/2015 Chung et al.
9,181,642 B2 11/2015 Cahuzac
2001/0026740 A1 10/2001 Yamanishi
2002/0160068 A1 10/2002 Nakamura
2004/0200014 A1 10/2004 Pons
2004/0237760 A1 12/2004 Shimizu
2005/0039769 A1 2/2005 Bousfield et al.
2005/0178026 A1 8/2005 Friton
2008/0189194 A1 8/2008 Bentvelzen
2009/0193961 A1 8/2009 Jensen et al.
2009/0306762 A1 12/2009 McCullagh et al.
2011/0203446 A1 8/2011 Dow et al.
2011/0232008 A1 9/2011 Crisp
2013/0167710 A1 7/2013 Dow et al.
2013/0239790 A1 9/2013 Thompson et al.
2013/0258085 A1 10/2013 Leedy et al.
2013/0269159 A1 10/2013 Robitaille et al.
2013/0304232 A1 11/2013 Gries
2013/0305466 A1 11/2013 Byeon
2013/0305911 A1 11/2013 Masson et al.
2014/0088688 A1 3/2014 Lilburn et al.
2014/0182170 A1 7/2014 Wawrousek et al.
2014/0182447 A1 7/2014 Kang et al.
2014/0230634 A1 8/2014 Nakai
2014/0283671 A1 9/2014 Head et al.
2014/0373389 A1 12/2014 Bruce
2014/0377488 A1 12/2014 Jamison
2015/0007451 A1 1/2015 Bruce
2015/0045831 A1 2/2015 Allen
2015/0299916 A1 10/2015 Reinisch
2016/0076178 A1 3/2016 Head et al.
2016/0158769 A1 6/2016 Hornek et al.
2016/0251786 A1 9/2016 Ichikawa
2016/0289873 A1 10/2016 Head
2016/0345676 A1 12/2016 Bruce et al.
2017/0037548 A1 2/2017 Lee

FOREIGN PATENT DOCUMENTS

EP 1 486 601 A1 12/2004
EP 2657384 A1 10/2013
GB 161552 12/1921
GB 477556 A 1/1938
GB 1196983 7/1970
JP H04174749 A 6/1992
JP H0995844 A 4/1997
JP 10-158965 A 6/1998
JP 2008-240187 A 10/2008
JP 2013147760 A 8/2013

(56) References Cited

FOREIGN PATENT DOCUMENTS

| | | | |
|---|---|---|---|
| KR | 2002-0038168 | A | 5/2002 |
| TW | M305221 | U | 1/2007 |
| TW | M447894 | U | 3/2013 |
| TW | 201328624 | A | 7/2013 |
| TW | M473088 | U | 3/2014 |
| TW | M487651 | U | 10/2014 |
| WO | 0153583 | A1 | 7/2001 |
| WO | 2009000371 | A1 | 12/2008 |
| WO | 2011111564 | A1 | 9/2011 |

OTHER PUBLICATIONS

David Branscomb, PhD. et al, "New Directions in Braiding", Journal of Engineered Fibers and Fabrics, http://www.jeffjournal/org, 2013, pp. 11-24, vol. 8, Issue 2.
U.S. Appl. No. 14/721,563, filed May 26, 2015.
U.S. Appl. No. 14/721,614, filed May 26, 2015.
Anonymous: "3D print shoe last", styleforum, Feb. 19, 2014 (Feb. 19, 2014), pp. 1-4, XP055241611, Retrieved from the Internet on Jan. 14, 2016: URL:http://www.styleforum.net/t/137783/3dprint-shoe-last.
Ricardo Bilton: "How 3D body scanning will help you find a suit that actually fits", May 2, 2013 (May 2, 2013), XP055241783, URL: http://venturebeat.com/2013/05/02/how-3d-body-scanning-will-help-you-find-a-suit-that-actually-fits/, Retrieved on Jan. 15, 2016.
International Search Report and Written Opinion dated Jan. 27, 2016 in International Patent Application No. PCT/US2015/055884, 14 pages.
International Search Report and Written Opinion dated Jan. 19, 2016 in International Patent Application No. PCT/US2015/055625, 10 pages.
International Search Report and Written Opinion dated Sep. 27, 2016 for International Patent Application No. PCT/US2016/034097, 13 pages.
International Search Report and Written Opinion dated Nov. 11, 2016 in International Patent Application No. PCT/US2016/034102, 19 pages.
International Search Report and Written Opinion dated Nov. 17, 2016 for International Patent Application No. PCT/US2016/045319, 13 pages.
Non-Final Office Action dated Jun. 1, 2017 in U.S. Appl. No. 14/821,125, 21 pages.
Notice of Allowance dated Jun. 21, 2017 in U.S. Appl. No. 14/565,682, 7 pages.
International Preliminary Report on Patentability dated Jun. 22, 2017 in International Patent Application No. PCT/US2015/055625, 5 pages.
International Preliminary Report on Patentability dated Jun. 22, 2017 in International Patent Application No. PCT/US2015/055884, 4 pages.
Non-Final Office Action dated Aug. 23, 2017 in U.S. Appl. No. 14/565,582, 9 pages.
Notice of Allowance dated Sep. 19, 2017 in U.S. Appl. No. 14/565,682, 7 pages.
Notice of Allowance dated Nov. 2, 2017 in U.S. Appl. No. 14/821,125, 7 pages.
International Preliminary Report on Patentability dated Dec. 7, 2017 in International Patent Application No. PCTUS2016034102, 13 pages.
International Preliminary Report on Patentability dated Dec. 7, 2017 in International Patent Application No. PCTUS2016034104, 13 pages.
International Preliminary Report on Patentability dated Dec. 7, 2017 in International Patent Application No. PCTUS2016034097, 9 pages.
Non-Final Office Action dated Feb. 22, 2018 in U.S. Appl. No. 14/721,614, 9 pages.
Non-Final Office Action dated Feb. 22, 2018 in U.S. Appl. No. 14/721,563, 10 pages.
Final Office Action dated Feb. 28, 2028 in U.S. Appl. No. 14/565,582, 9 pages.
Office Action dated Feb. 16, 2018 in Australian Patent Application No. 2015361192, 3 pages.
International Preliminary Report on Patentability dated Feb. 22, 2018 in International Patent Application No. PCTUS2016045319, 9 pages.

* cited by examiner

BRAIDING MACHINE WITH NON-CIRCULAR GEOMETRY

BACKGROUND

In conventional braiding machines, spools carrying thread, filaments, yarn or other tensile elements are placed on carriages that are disposed around a circular track between rotor metals. The carriages are typically elliptical or oval in shape. Thread, filaments, yarn or other tensile elements, extend from the spools to a braiding point in the middle of the braiding machine. Each of the rotor metals may be rotated to sweep its adjacent carriages into new positions, and to twist the thread, filaments, yarn or other tensile elements extending from the spools mounted on the carriages around each other.

Braiding machines may be used to make braided articles of manufacture, such as articles of footwear. Conventional articles of footwear generally include two primary elements, an upper and a sole structure. The upper is secured to the sole structure and forms a void on the interior of the footwear for receiving a foot in a comfortable and secure manner. The upper member may secure the foot with respect to the sole member. The upper may extend around the ankle, over the instep and toe areas of the foot. The upper may also extend along the medial and lateral sides of the foot as well as the heel of the foot. The upper may be configured to protect the foot and provide ventilation, thereby cooling the foot. Further, the upper may include additional material to provide extra support in certain areas.

A variety of material elements (e.g. textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch-resistance, wear resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas.

SUMMARY

Some embodiments of the braiding machine may have rotor metals arranged along a rotor track with carriages disposed between the rotor metals on the rotor track. Each rotor metal might have two opposing concave sides, so one carriage adjoins each of the two concave sides of the rotor metals. Rotation of any of the rotor metals sweeps its adjoining carriages from a first set of positions to a second set of positions. The rotor track has at least a first portion and a second portion, and the radius of curvature of the second portion of the rotor track is substantially greater than the radius of curvature of the first portion of the rotor track.

Some embodiments of the braiding machine may have rotor metals on a rotor track, with carriages on the rotor track between the rotor metals. The rotor track may have an outer perimeter which forms a simple closed curve that encloses an area. The area enclosed by the outer perimeter of the rotor track is substantially less than the area enclosed by a circle whose circumference is equal to the length of the outer perimeter of the simple closed curve.

Some embodiments of the braiding machine may have a rotor track that has an inner perimeter that forms a simple closed curve, and rotor metals arranged along the rotor track. Carriages may be disposed on the rotor track adjoining the rotor metals, and spools may be mounted on the carriages. A mandrel may be positioned at a braid point within the simple closed curve formed by the inner perimeter of the rotor track. In these embodiments, the longest distance from each of the spools to the mandrel is at least 20% greater than the shortest distance from each of the plurality of spools to the mandrel. Tensile elements such as yarns, threads, strings, filaments or fibers that are wound around the spools extend from each spool to the mandrel.

Other systems, methods, features and advantages of the braiding machines described herein will be, or will become, apparent to one of ordinary skill in the art upon examination of the following figures and detailed description. It is intended that all such additional systems, methods, features and advantages be included within this description and this summary, and be protected by the following claims.

BRIEF DESCRIPTION OF THE DRAWINGS

The braiding machines disclosed herein can be better understood with reference to the following drawings and description. The components in the figures are not necessarily to scale, emphasis instead being placed upon illustrating the overall structure and operation of the braiding machines. Moreover, in the Figures, like reference numerals designate corresponding parts throughout the different views.

DETAILED DESCRIPTION

Figure 1:
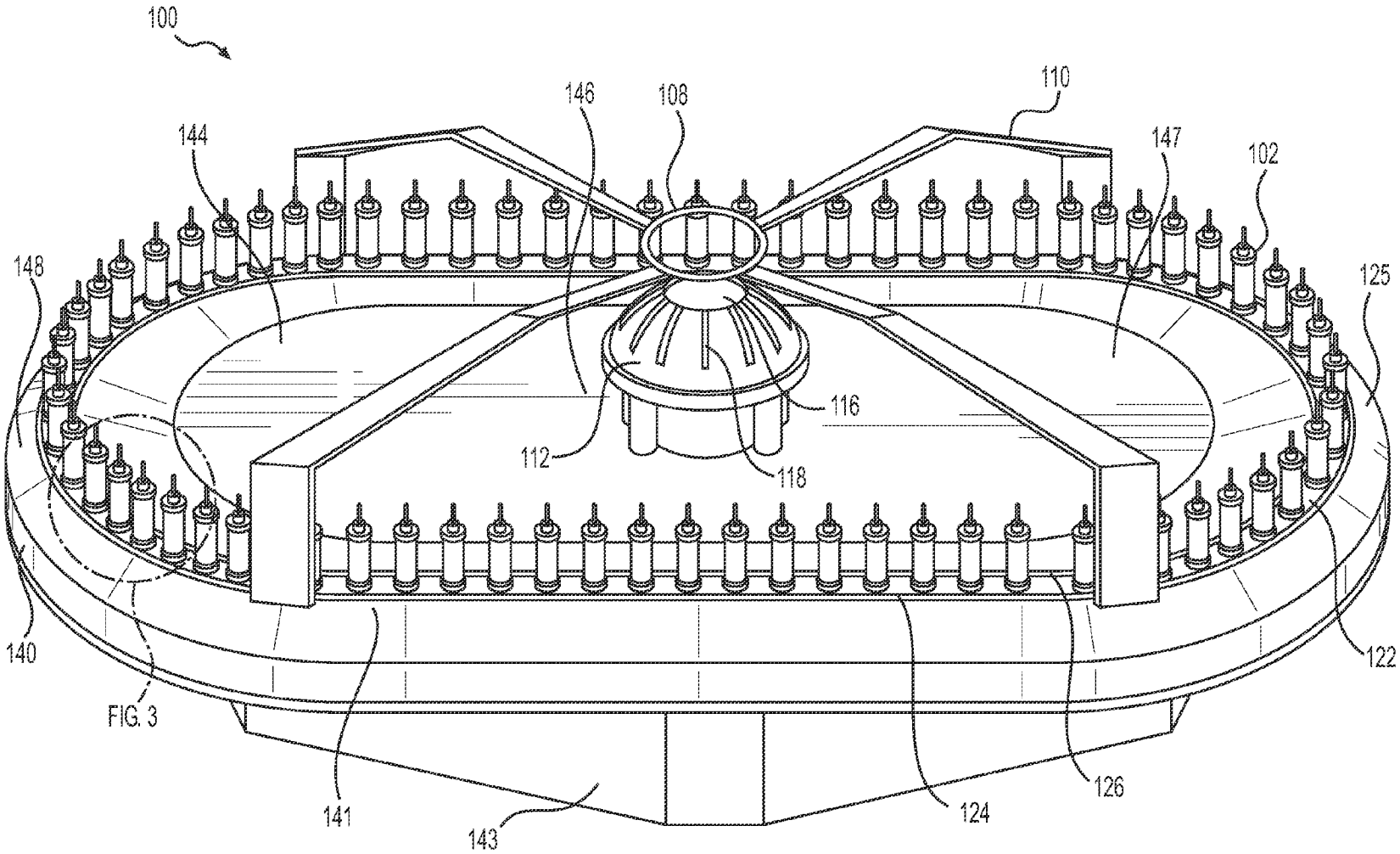
FIG. 1 is a schematic view of an embodiment of a braiding machine that has a racetrack geometry.

For clarity, the detailed descriptions herein describe certain exemplary embodiments, but the disclosure herein may be applied to any article of footwear comprising certain features described herein and recited in the claims. In particular, although the following detailed descriptions describe braiding machines with certain exemplary configurations, it should be understood that the descriptions herein apply generally to other configurations that fall within the scope of the claims. Accordingly, the scope of the claims is not limited to the specific embodiments described herein and illustrated in the drawings.

For consistency and convenience, directional adjectives may be employed throughout this detailed description corresponding to the illustrated embodiments. The term "longitudinal axis" as used throughout this detailed description and in the claims with respect to a component refers to an axis extending along the longest dimension of that component. Also, the term "lateral axis" as used throughout this detailed description and in the claims with respect to a component refers to an axis extending from side to side, and may generally be perpendicular to the longitudinal axis of that component.

The detailed description and the claims may make reference to various kinds of tensile elements, braided structures, braided configurations, braided patterns and braiding machines.

As used herein, the term "tensile element" refers to any kind of threads, yarns, strings, filaments, fibers, wires, cables as well as possibly other kinds of tensile elements described below or known in the art. As used herein, tensile elements may describe generally elongated materials with lengths much greater than their corresponding diameters. In some embodiments, tensile elements may be approximately one-dimensional elements. In some other embodiments, tensile elements may be approximately two-dimensional (e.g., with thicknesses much less than their lengths and widths). Tensile elements may be joined to form braided structures. A "braided structure" may be any structure formed intertwining three or more tensile elements together. Braided structures could take the form of braided cords, ropes or strands. Alternatively, braided structures may be configured as two dimensional structures (e.g., flat braids) or three-dimensional structures (e.g., braided tubes or other three-dimensional articles).

A braided structure may be formed in a variety of different configurations. Examples of braided configurations include, but are not limited to: the braiding density of the braided structure, the braid tension(s), the geometry of the structure (e.g., formed as a tube, an article, etc.), the properties of individual tensile elements (e.g., materials, cross-sectional geometry, elasticity, tensile strength, etc,) as well as other features of the braided structure. One specific feature of a braided configuration may be the braid geometry, or braid pattern, formed throughout the entirety of the braided configuration or within one or more regions of the braided structure. As used herein, the term "braid pattern" refers to the local arrangement of tensile strands in a region of the braided structure. Braid patterns can vary widely and may differ in one or more of the following characteristics: the orientations of one or more groups of tensile elements (or strands), the geometry of spaces or openings formed between braided tensile elements, the crossing patterns between various strands as well as possibly other characteristics. Some braided patterns include lace-braided or jacquard patterns, such as Chantilly, Bucks Point and Torchon. Other patterns include biaxial diamond braids, biaxial regular braids, as well as various kinds of triaxial braids.

Braided structures may be formed using braided machines. As used herein, a "braiding machine" is any machine capable of automatically intertwining three or more tensile elements to form a braided structure. Braiding machines may generally include spools, or bobbins, that are moved or passed along various paths on the machine. As the spools are passed around, tensile strands extending from the spools towards a center of the machine may converge at a "braiding point" or braiding area. Braiding machines may be characterized according to various features including spool control and spool orientation. In some braiding machines, the position and movement of the spools may be independently controlled so that each spool can travel on a variable path throughout the braiding process, hereafter referred to as "independent spool control". Other braiding machines, however, may lack independent spool control, so that each spool is constrained to travel along a fixed path around the machine. Additionally, in some braiding machines, the central axes of each spool point in a common direction so that the spool axes are all parallel; this configuration is referred in this specification to as an "axial configuration". In other braiding machines, the central axis of each spool is oriented towards the braiding point (e.g., radially inwards from the perimeter of the machine towards the braiding point); this configuration is referred to in this specification as a "radial configuration."

One type of braiding machine that may be used to make braided articles is a radial braiding machine or radial braider. A radial braiding machine may lack independent spool control and may therefore be configured with spools that pass in fixed paths around the perimeter of the machine. In some cases, a radial braiding machine may include spools arranged in a radial configuration. For purposes of clarity, the detailed description and the claims may use the term "radial braiding machine" to refer to any braiding machine which lacks independent spool control. The present embodiments could make use of any of the machines, devices, components, parts, mechanisms and/or processes related to a radial braiding machine as disclosed in Dow et al., U.S. Pat. No. 7,908,956, issued Mar. 22, 2011, and titled "Machine for Alternating Tubular and Flat Braid Sections," and as disclosed in Richardson, U.S. Pat. No. 5,257,571, issued Nov. 2, 1993, and titled "Maypole Braider Having a Three Under and Three Over Braiding path," the entirety of each patent being herein incorporated by reference in its entirety. These applications may be referred to herein as the "Radial Braiding Machine" applications.

Another type of braiding machine that may be used to make braided articles is a braiding machine, also known as a Jacquard or Braiding machine. In these braiding machines the spools may have independent spool control. Some braiding machines may also have axially arranged spools. The use of independent spool control may allow for the creation of braided structures, such as lace braids, that have an open and complex topology, and may include various kinds of stitches used in forming intricate braiding patterns. For purposes of clarity, the detailed description and the claims may use the term "braiding machine" to refer to any braiding machine which has independent spool control. The present embodiments could make use of any of the machines, devices, components, parts, mechanisms and/or processes related to a braiding machine as disclosed in Ichikawa, EP Patent Number 1486601, published on Dec. 15, 2004, and titled "Torchon Lace Machine," and as disclosed in Malhere, U.S. Pat. No. 165,941, issued Jul. 27, 1875, and titled "Lace-Machine," the entirety of each of these references is incorporated by reference herein in their entireties.

Spools may move in different ways according to the operation of a braiding machine. In operation, spools that are moved along a constant path of a braiding machine may be said to undergo "Non-Jacquard motions", while spools that move along variable paths of a braiding machine are said to undergo "Jacquard motions." Thus, as used herein, a braiding machine provides means for moving spools in Jacquard motions, while a radial braiding machine can only move spools in Non-Jacquard motions.

The term "overbraid" as used herein shall refer to a method of braiding that forms along the shape of a three dimensional structure. An object that is to be overbraided includes a braid structure that extends around the outer surface of the object. An object that is overbraided does not necessarily include a braided structure encompassing the entire object, rather, an object that is overbraided includes a seamless braided structure that extends from back to front of the object.

Generally, braided structures are configured in two main ways, tubular and flat braids. Traditionally, lace braiding machines are used to form flat braided structures. An example of a lace braiding machine can be found in Malhere, U.S. Pat. No. 165,941, granted Jul. 27, 1875, entitled "Lace-Machine," the entirety of which is hereby incorporated by reference. Braiding machines may form intricate designs that may involve twisting yarn or intertwining yarn in various manners. Braiding machines are machines that include rotor metals that may be controlled specifically such that each individual rotor metal may be individually rotated.

In contrast, radial braiding machines typically use intermeshed horn gears such that specific horn gears cannot be individually rotated. An example of a radial braiding machine is described in Richardson, U.S. Pat. No. 5,257,571, granted Nov. 2, 1993, entitled "Maypole Braider Having a Three Under and Three Over Braiding Path," the entirety of which is hereby incorporated by reference. The braided structure or format of the strands of the braided structure formed in a radial braiding machine is generally the same or similar throughout the length of the radial braided structures. That is, there may be little or no variation in the braided structure of an article formed on a radial braiding machine.

The drawings in this specification are schematic diagrams that are not intended to represent the actual dimensions, relative dimensions or proportional dimensions of the machines or components depicted therein, but are instead intended only to clearly illustrate the embodiments described in the textual description.

The embodiments may use any of the machines, devices, components and/or methods disclosed in Bruce et al., U.S. Patent Publication Number 20160345676, corresponding to U.S. patent. application Ser. No. 14/721,563, filed May 26, 2015, entitled "Braiding Machine and Method of Forming an Article Incorporating Braiding Machine," and in Bruce et al., U.S. Patent Publication Number 20160345677, corresponding to U.S. patent application Ser. No. 14/721,614, filed May 26, 2015, entitled "Braiding Machine and Method of Forming an Article Incorporating a Moving Object," which are both hereby incorporated by reference in their entireties.

Figure 2:
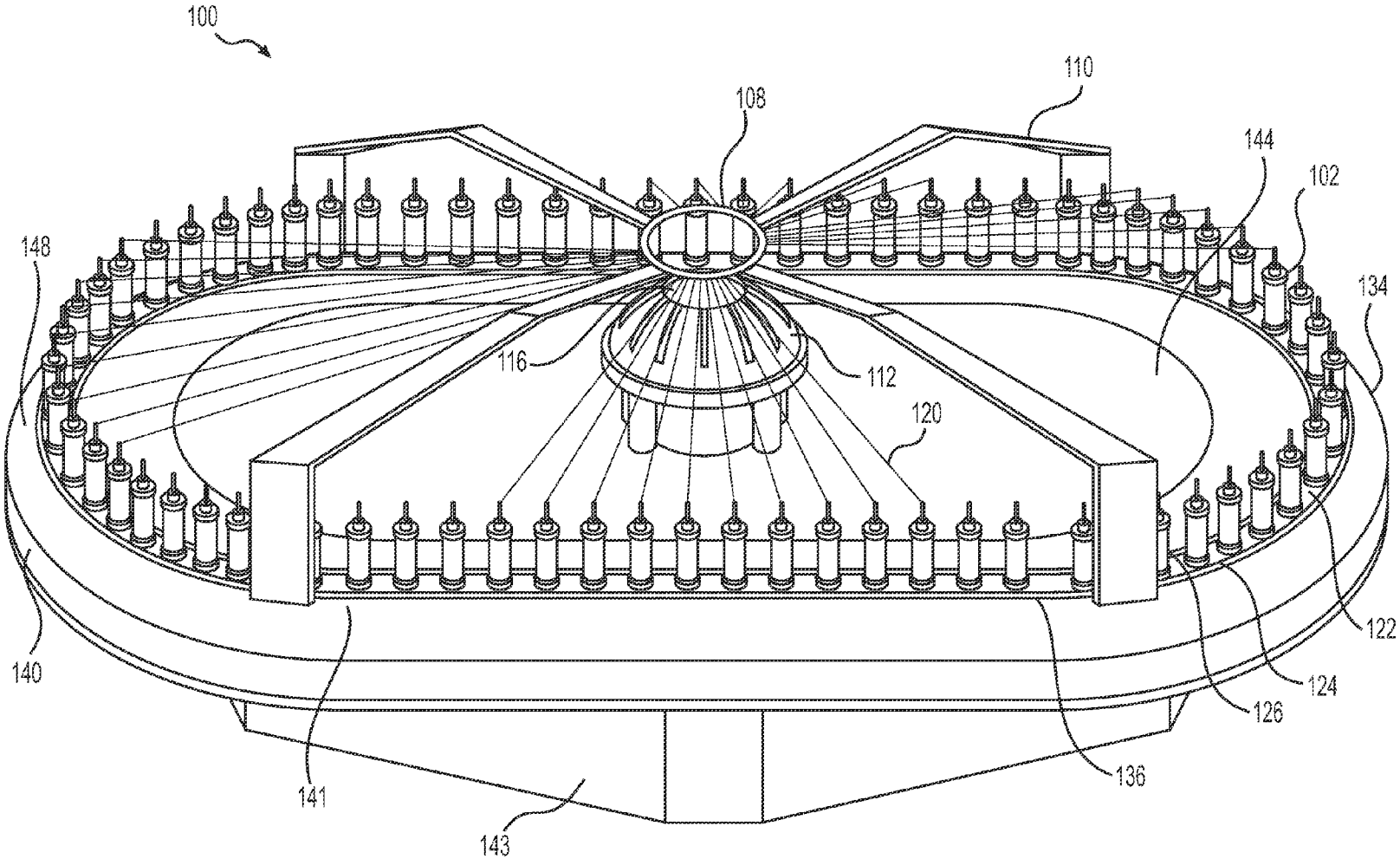
FIG. 2 is another schematic view of the braiding machine of FIG. 1.
Figure 3:
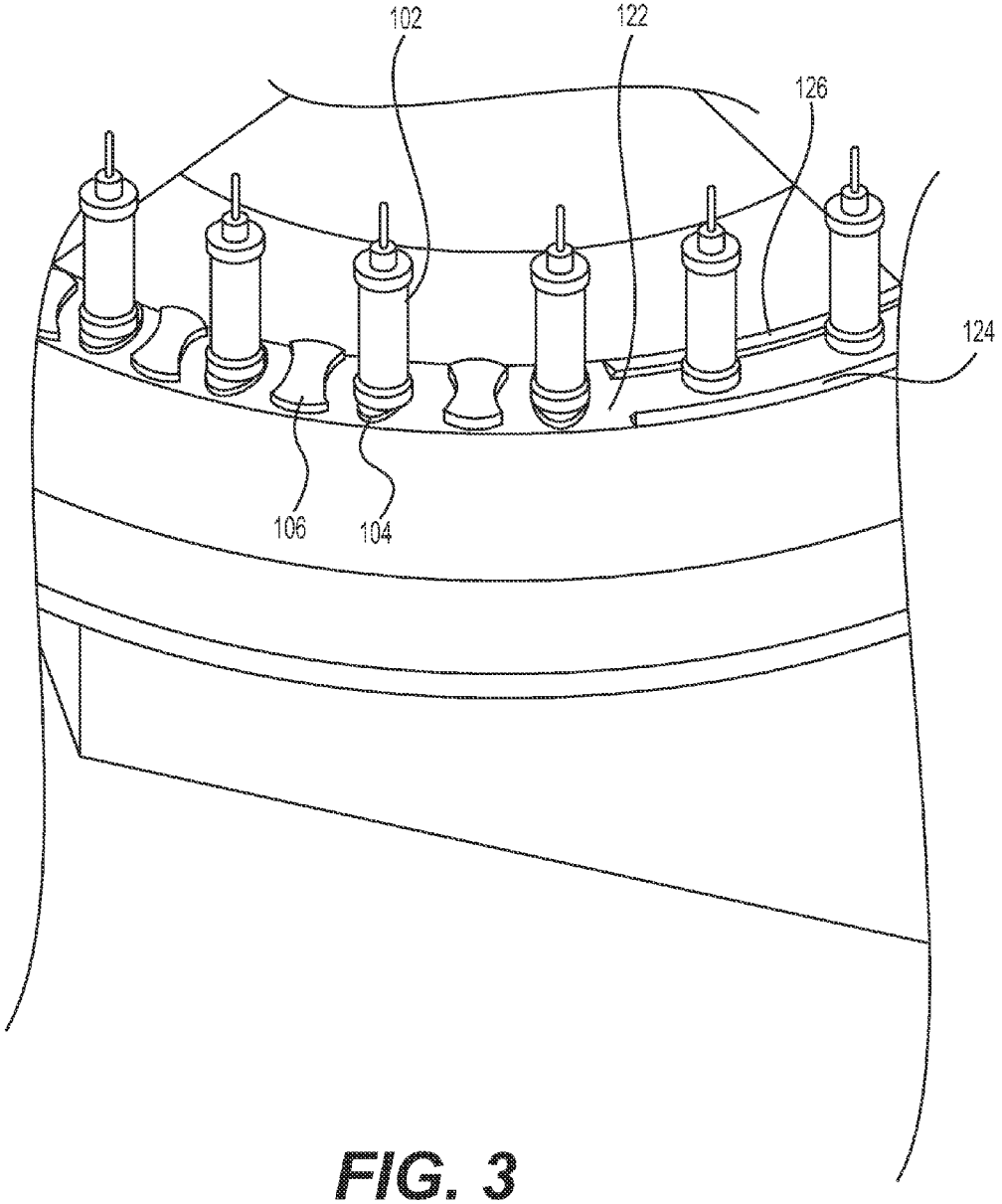
FIG. 3 is a close-up view of a portion of the lace braiding machine shown in FIG. 2.
Figure 4:
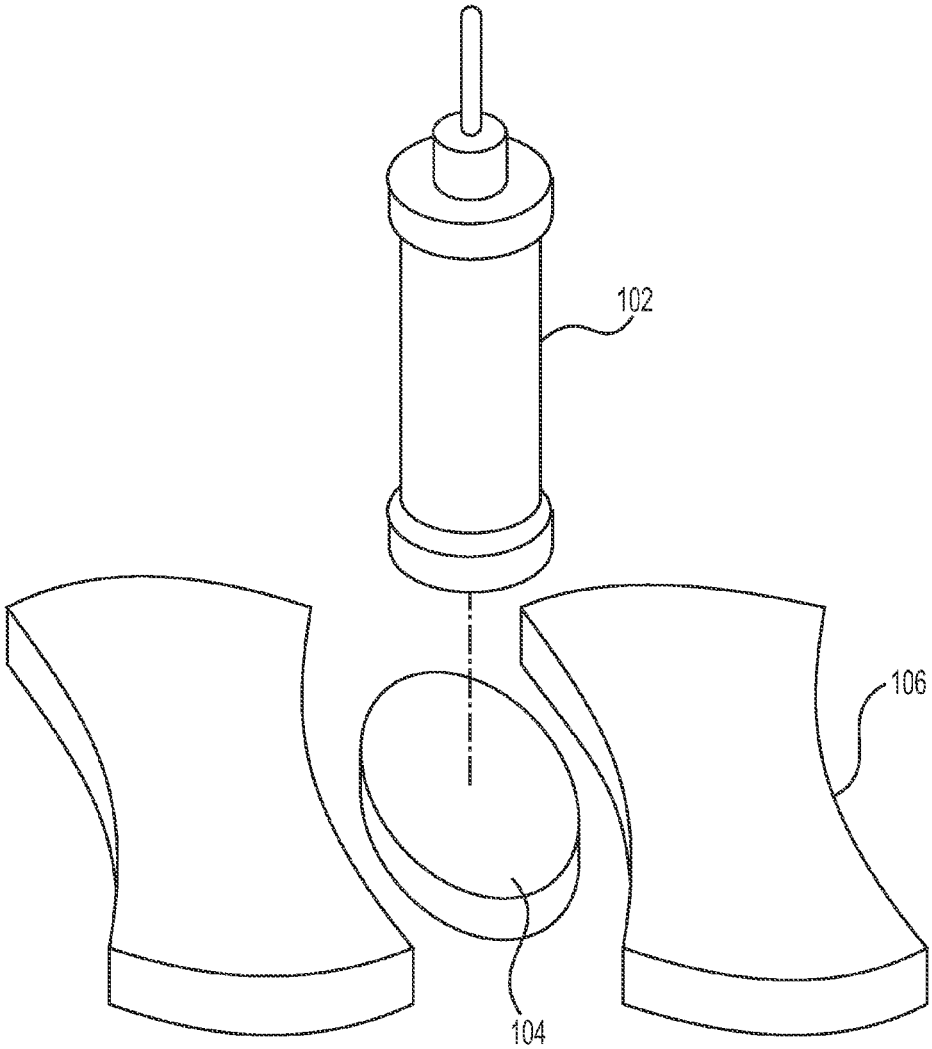
FIG. 4 is an exploded view of certain of the components shown in FIG. 2.

FIG. 1 and FIG. 2 are schematic diagrams of a braiding machine 100 that has a "racetrack" configuration. In some embodiments, the braiding machine may be a Torchon braiding machine. FIG. 1 shows the main components of a braiding machine. A number of spools 102 are disposed along a track 122 at the perimeter 125 of the braiding machine 100. Spools 102 are supported by an equal plurality of carriages 104, which are shown in FIG. 3 and FIG. 4. As shown in FIG. 2, tensile elements 120 may be wrapped around the plurality of spools 102 such that when tensile elements 120 are pulled towards a braiding point at the center of the machine above enclosure 112, tensile elements 120 may unwind or unwrap from the plurality of spools 102. Tensile elements 120 may be oriented to extend through ring 108 (which are supported by structure 110) and wrap around a last, form or mandrel, for example, to form a braided structure.

As shown in FIGS. 1-3, the base portion 140 of braiding machine 100 may comprise a platform 141 and a supporting structure 143. Platform 141 provides a solid foundation for supporting track 122, enclosure 112, rotor metals 106, carriages 104 and spools 102. In this embodiment, platform 141 extends beyond supporting structure 143 in all directions. Platform 141 has a top surface 144 which is bounded by inner wall 126 of track 122. As shown in FIG. 3, track 122 also has an outer wall 124 which, together with inner wall 126 constrain the movement of oval carriages 104 on track 122. It should be noted that, in FIG. 3, for example, the rotor metals and oval carriages are spaced somewhat further apart in the illustration than would be the case in an actual lace braiding machine.

Supporting structure 143, shown in FIG. 1 and FIG. 2, may have a truncated diamond geometry, as in the embodiment shown in FIG. 1 and FIG. 2, or it may have a generally rectangular geometry, a generally oval geometry, a generally square geometry or a generally circular geometry. In some embodiments, supporting structure 143 may include vibration damping elements (not shown) to minimize vibrations generated by braiding machine 100 from propagating to other braiding machines as well as to minimize vibrations propagating from other braiding machines or other apparatus from propagating up to platform 141.

In the embodiment shown in FIG. 1 and FIG. 2, platform 141 has a central surface portion 146 and a peripheral surface portion 147. In some embodiments, platform 141 may also have a sidewall portion 148, as shown in FIG. 1 and FIG. 2.

In some embodiments, the plurality of spools 102 may be located in a position guiding system. In some embodiments, the plurality of spools 102 may be located within a track. As shown, in this embodiment track 122 has a short inner wall 126 and a short outer wall 124 that may secure plurality of spools 102 such that as tensile element 120 is tensioned or pulled, plurality of spools 102 may remain within track 122 without falling over or becoming dislodged.

Tensile elements 120 may be formed of different materials. The properties that a particular type of tensile element will impart to an area of a braided component partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the tensile element selected for formation of a braided component may affect the properties of the braided component. For example, a tensile element may be a monofilament thread or a multifilament thread. The tensile element may also include separate filaments that are each formed of different materials. In addition, the tensile element may include filaments that are each formed of two or more different materials, such as a two-component thread with filaments having a sheath-core configuration or with filaments twisted around each other.

In some embodiments, the plurality of spools 102 may be evenly spaced around a perimeter portion of braiding machine 100. In other embodiments, the plurality of spools 102 may be spaced differently than in the embodiment shown in FIG. 1. For example, in some embodiments, the plurality of spools 102 may be located only along portions the perimeter of lace the braiding machine. For example, in some embodiments, each spool may not be located directly adjacent to another spool.

In some embodiments, the plurality of spools 102 are mounted on carriages 104 which are located between rotor metals 106 along track 122, as shown in FIG. 3 and in exploded view in FIG. 4. Track 122 has an outer wall 124 and an inner wall 126 that constrain the rotor metals 106 and the carriages 104 such that they cannot leave track 122.

The dimensions of the rotor metals, the dimensions of the oval carriages, the radius of curvature of the side of the rotor metals facing the oval carriage, and the radius of curvature of the sides of the oval carriage facing the rotor metals are selected such that the rotor metals may engage the oval carriages when the rotor metals are rotated. The specific spacing between the carriages and the rotor metals may be selected according to the geometry of the track to allow the rotation of the rotor metals to move the carriages around. For example, in a linear portion of a track, less space may be required between a rotor metal and its adjoining carriages than in a curved portion of the track.

In some embodiments, the carriages may have an oval shape. For example, in the embodiment shown in FIG. 4 spools 102 are mounted on, for example, oval carriages 104. Oval carriages 104 are positioned adjoining rotor metals 106 such that when one of the rotor metals is rotated, it sweeps its adjacent oval carriages around, as described below with reference to FIGS. 12-14. The inner wall 126 and the outer wall 124 ensure that the rotor metals remain on track 122 as they are swept from one position to an opposite position.

In some embodiments, some or all of the rotor metals 106 may be rotated both clockwise and counterclockwise. In other embodiments, some or all of the rotor metals may only be rotated in one direction. In any case, as they are rotated, the rotor metals sweep carriages 104 and spools 102 around on track 122 between wall 124 and wall 126, and, in so doing, may twist tensile elements of adjoining spools around each other. For example, when a rotor metal 106 is rotated 180 degrees, the tensile element from one spool 102 may intertwine with the tensile element from an adjacent spool 102, and the two carriages on either side of that rotor metal 106 exchange positions, as explained below with reference to FIGS. 12-14, for example.

In some embodiments, the rotation of the rotor metals 106 to move carriages 104 and spools 102 may be programmable. In some embodiments, the rotation of rotor metals 106 and thus the movement of spools 102 may be programmed into a computer system. In other embodiments, the movement of plurality of spools 102 may be programmed using a punch card or other device. The movement of plurality of spools 102 may be pre-programmed to form particular shapes or designs, and/or to obtain a designed thread density.

In some embodiments, not every one of carriages 104 may have a spool 102 mounted on each of the carriages 104. For example, in some embodiments only certain portions of the track 122 may have spools 102 mounted on carriages 104, and other portions may not have spools 102 on their carriages 104, and yet other portions may have neither spools 102 nor carriages 104. In other embodiments, a different configuration of spools 103 may be placed on each of the carriages 104. Thus the configuration of the spools and the location of the spools may vary throughout the braiding process.

Braiding machine 100 may be positioned in various orientations. For example, braiding machine 100 may be oriented horizontally, such that the plurality of spools 102 extend vertically. In other embodiments, the braiding machine may be oriented vertically and the plurality of spools may extend horizontally.

In some embodiments, individual spools may have the capability of being moved completely around the perimeter of braiding machine 100. In some embodiments, each spool of plurality of spools 102 may be moved completely around the perimeter of braiding machine 100, as described below with reference to FIGS. 12-14. In still further embodiments, some spools of the plurality of spools 102 may rotate completely around the perimeter of braiding machine 100 while other spools of plurality of spools 102 may rotate only partially around braiding machine 100. By varying the rotation and location of individual spools of plurality of spools 102, various braid configurations may be formed.

In some embodiments, a braiding machine may include a tensile element organization member. The tensile element organization member may assist in organizing the tensile elements such that entanglement of the tensile elements may be reduced. Additionally, the tensile element organization member may provide a path or direction through which a braided structure is directed. For example, as shown in FIGS. 1-2, braiding machine 100 may include a fell or ring 108 to facilitate the organization of a braided structure. The tensile elements of each spool extend towards and through ring 108 before forming a braided structure. As the strands extend through ring 108, ring 108 may guide tensile elements 120 such that tensile elements 120 extend generally in the same direction.

In some embodiments, ring 108 may be located at a braid point. The braid point is defined as the point or area where tensile elements 120 consolidate to form a braid structure. As a general rule, in most embodiments the braid point is positioned approximately at the geometric center of the closed curve formed by the inner perimeter of the rotor track. For example, if the smallest distance from any point on the inner perimeter of the braiding machine to the geometric center of the braiding machine is d cm, then the braid point may be within (d/20) cm of the geometric center of the closed curve. As the plurality of spools 102 pass around braiding machine 100, tensile elements 120 from each spool of the plurality of spools 102 may extend toward and through ring 108. As the tensile elements 120 approach ring 108, the distance between tensile elements 120 from different spools diminishes and the tensile elements 120 twist around each other to form a braided structure. Thus tensile elements 120 from different spools 102 intermesh or braid with one another.

In some embodiments, braiding machine 100 includes an enclosure 112 at a central position. Enclosure 112 may be used to house certain devices that assist in controlling the disposition of the tensile elements 120 as they reach ring 108. For example, "knives" (not shown in FIG. 1) may extend through slots 118 in enclosure 112 to press tensile elements 120 upward towards ring 108. In some embodiments, the knives may prevent tensile elements 120 from unraveling and/or assist in providing a tight and uniform braided structure. An opening 116 at the top of the enclosure 112 may be aligned with a ring 108. For example, in some embodiments, the central point of ring 108 may be aligned with the center of opening 116.

In some embodiments, opening 116 may be located above track 122. For example, opening 116 may be located vertically above platform 141. That is, in some embodiments, the plane in which opening 116 is located may be vertically above the plane in which the spools 102 are located. In other embodiments, opening 116 may be located in the same plane as the plurality of spools 102 or of track 122.

In some embodiments, an object such as a last, mandrel or form or other article may be used to form the three-dimensional shape of the braided component. In some of these embodiments, the object may be fed up to the braiding point through opening 116 in enclosure 112 up to the braiding area. In other embodiments, the object may be stationary.

The geometry of the "racetrack" configuration of the embodiment shown schematically in FIG. 1 and FIG. 2 can be described as forming a simple convex closed curve that has two opposing semi-circular portions 134 joined by two linear portions 136. This configuration provides three significant advantages. First, the area enclosed by a braiding machine with a racetrack geometry for a given perimeter is significantly smaller than the area enclosed by a circular braiding machine. Since the number of spools that can be placed on a braiding machine is directly proportional to the length of its perimeter, more spools may be mounted on a racetrack braiding machine than on a circular braiding machine that covers the same area. The greater number of spools around the perimeter of a braiding machine may provide for tighter braiding, a greater braid density and/or a higher throughput for the machine. Second, the smallest distance from any position on the perimeter of a braiding machine with a racetrack geometry to the braiding point at the center of the braiding machine is significantly smaller that the smallest distance from any position on the perimeter of a circular braiding machine to the center of the braiding machine. This allows an operator to more easily reach in to the braiding point to make any necessary adjustments or to clean the machinery at the braiding point. Third, the generally elongate shape of the racetrack configuration allows more efficient use of floor space in a factory with multiple braiding machines, as described below with reference to FIG. 18.

Figure 5:
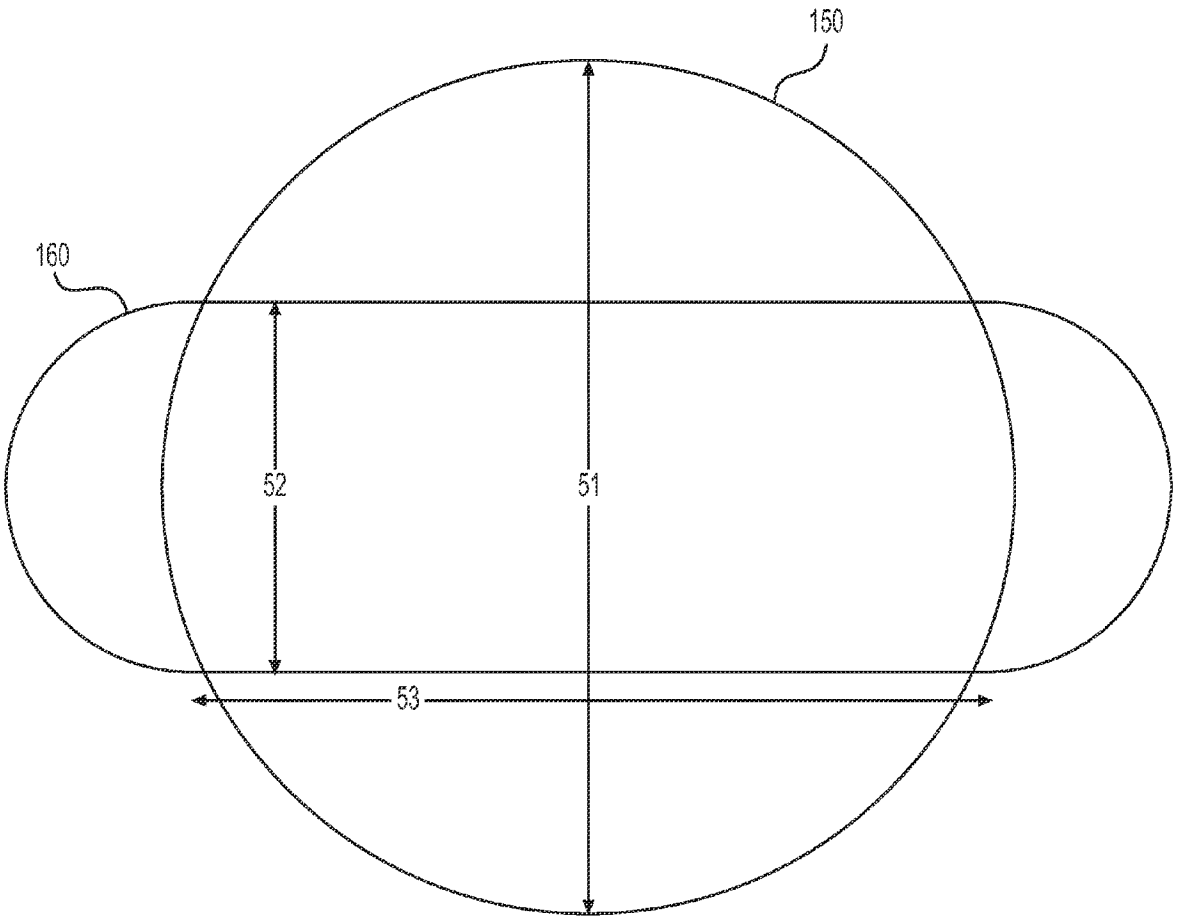
FIG. 5 is a schematic diagram comparing the area covered by a braiding machine with a circular geometry to the area covered by a braiding machine with a racetrack geometry that has the same perimeter as the circular machine.
Figure 6:
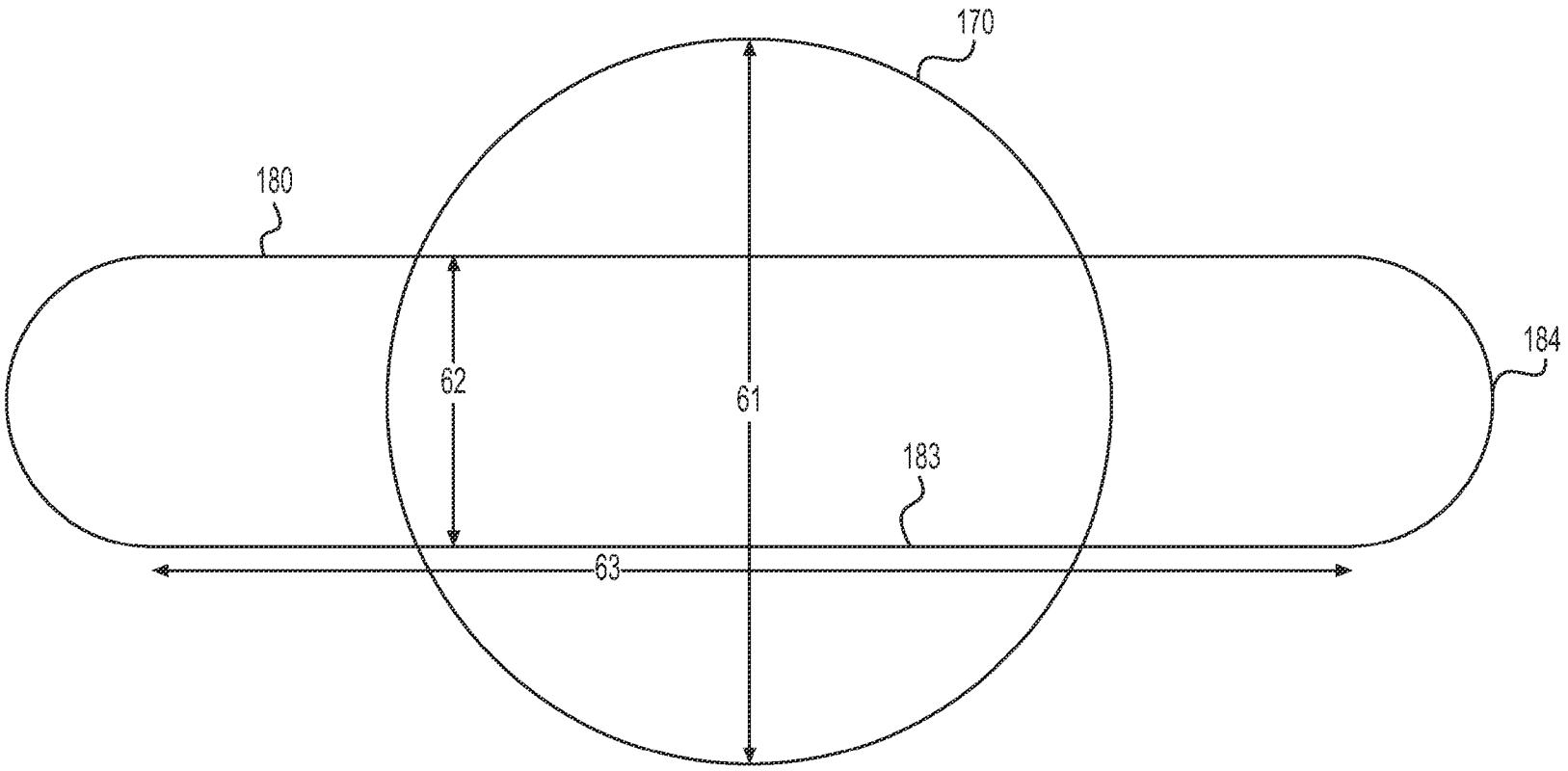
FIG. 6 is a schematic diagram comparing the perimeter of a braiding machine with a circular geometry to the perimeter of a braiding machine with a racetrack geometry that has the same area as the circular machine.

FIG. 5 and FIG. 6 illustrate the first of these advantages, that a braiding machine with a non-circular shape may be able to support more spools around its perimeter for a given area than a circular braiding machine. FIG. 5 shows a circle 150 that has a diameter 51 superimposed upon a racetrack 160 that has semi-circular end portions 164 with a diameter 52 and a rectangular middle portion that has a length 53. Here, circle 150 represents the approximate area taken up by a braiding machine with a circular shape, while the racetrack 160 represents the approximate area taken up by a braiding machine with a racetrack shape. Circle 150 and racetrack 160 have approximately the same perimeter, but circle 150 fills up much more space—in this example, the racetrack braiding machine uses substantially less space than a circular braiding machine would use. "Substantially" in the context of the area covered by a braiding machine means that the non-circular braiding machine would use less than 70% of the space that a circular machine that has a circumference which is equal to the length of the perimeter of the non-circular braiding machine.

FIG. 6 shows a circle 170 with a diameter 61 superimposed upon a racetrack 180 that has semi-circular ends 184 with a diameter 62 and a rectangular middle portion 183 that has a length 63. Circle 170 and racetrack 180 cover approximately the same area, but racetrack 180 has a much longer perimeter. In this case the perimeter of racetrack 180 is approximately 44% longer than the perimeter of circle 170.

Figure 7:
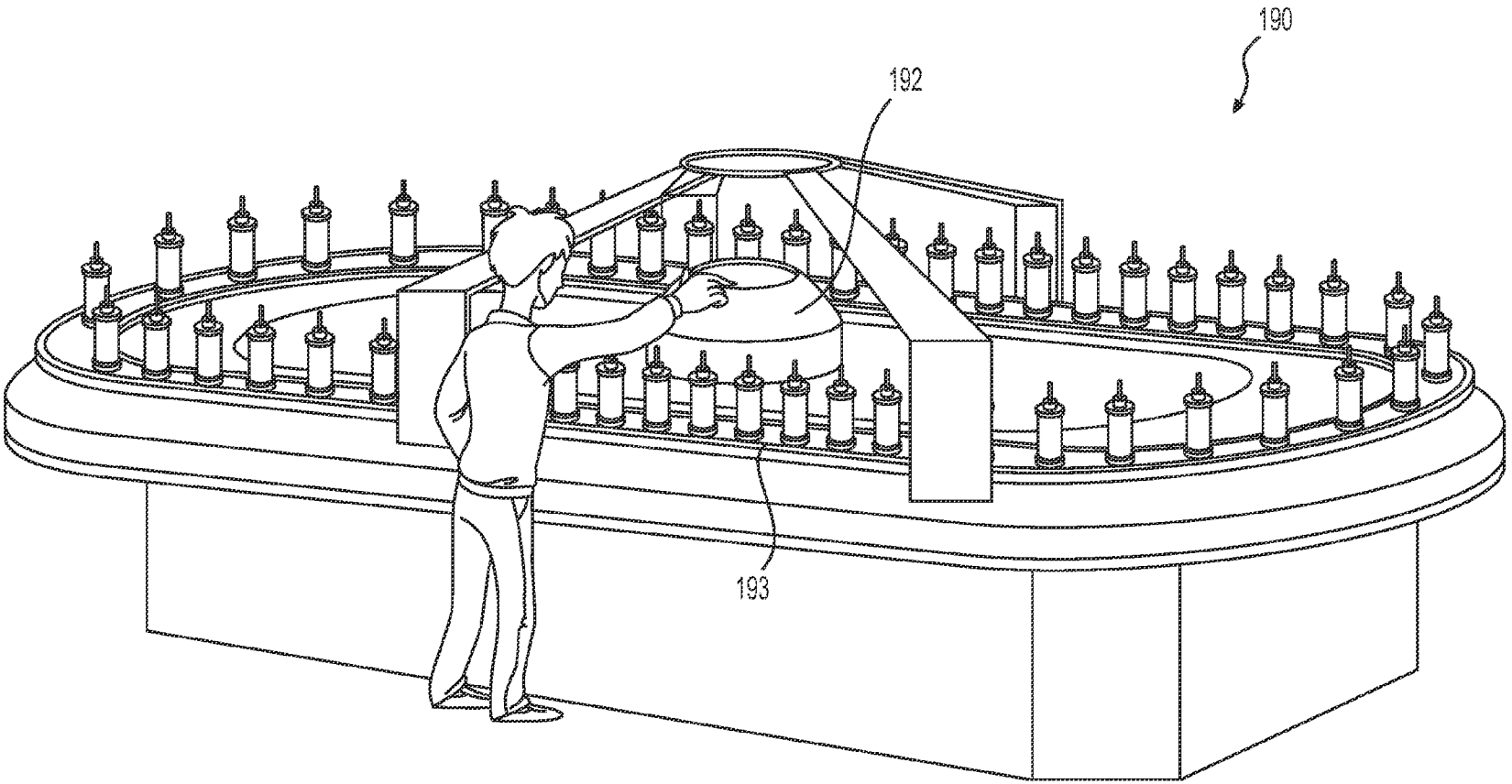
FIG. 7 is a schematic diagram showing a workman reaching to the middle of a lace b raiding machine.

FIG. 7 illustrates the second advantage of the racetrack configuration. In this illustration, a workman is reaching in towards enclosure 192 at the center of the braiding machine 190, for example to clean its surface or to make an adjustment. Because the distance from the edge 193 of the Braiding machine to its center is much smaller for a braiding machine with a racetrack geometry, the workman is able to reach the center of the racetrack braiding machine even though he would not have been able to reach the center of a circular braiding machine.

Figure 8:
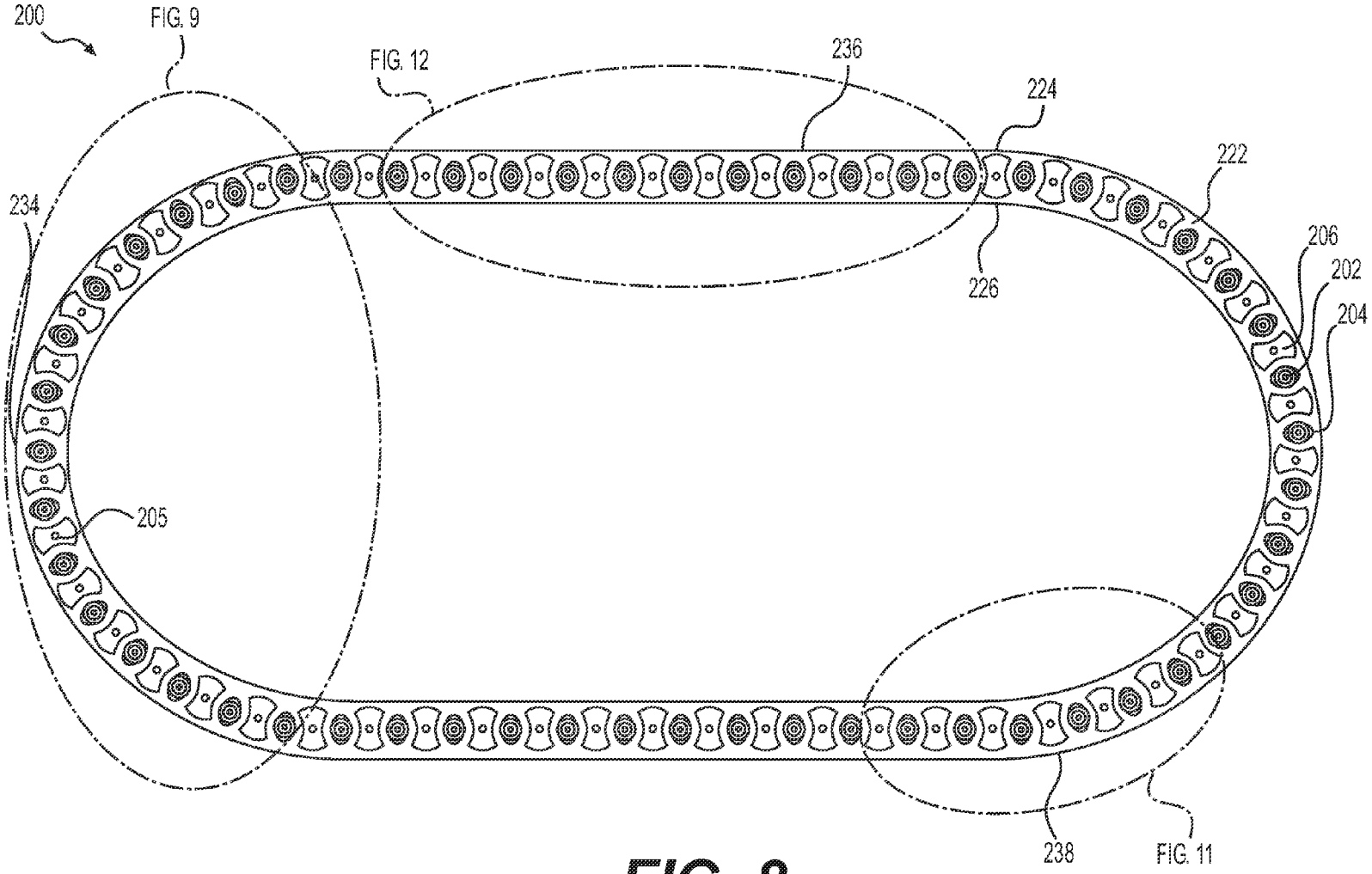
FIG. 8 is a schematic diagram of a braiding machine that has a racetrack configuration.

An example of the operation of a braiding machine is illustrated in FIGS. 8-12. For clarity, these figures do not include certain of the components of a braiding machine, such as tensile elements, an enclosure or a ring. FIG. 8 is a plan view of an example of a braiding machine 200 that has a racetrack configuration with spools 202 disposed on oval carriages 204. In this example, braiding machine 200 has 55 rotor metals (i.e., rotor metals 206), 55 carriages (i.e., carriages 204) and 55 spools (i.e., spools 202) disposed on a track 222 bounded by exterior wall 224 and interior wall 226. Other embodiments may have a greater or a lesser number of rotor metals, carriages and/or spools. As shown in FIG. 8, each spool 202 which is mounted on a carriage 204 has a rotor metal 206 on each of its sides. Rotor metals 206 may be rotated, either clockwise or counterclockwise, by shafts 205. Note that the positions of each of rotor metals 206 are fixed because shafts 205 can only rotate—they cannot move in any vertical, lateral or longitudinal direction. Thus the spacing between rotor metals 206, which is determined by the spacing between shafts 205, also determines the approximate spacing of oval carriages 204 and spools 202 The "FIG. 9" dashed outline of the racetrack demarcates a semi-circular portion 234 of the Braiding machine 200, which is shown in an expanded view in FIG. 9; the "FIG. 11" dashed outline demarcates a transition portion 238 of braiding machine 200 which is shown in expanded view in FIG. 11; and the "FIG. 12" dashed outline demarcates a linear portion 236 which is shown in an expanded view in FIG. 12.

Figure 9:
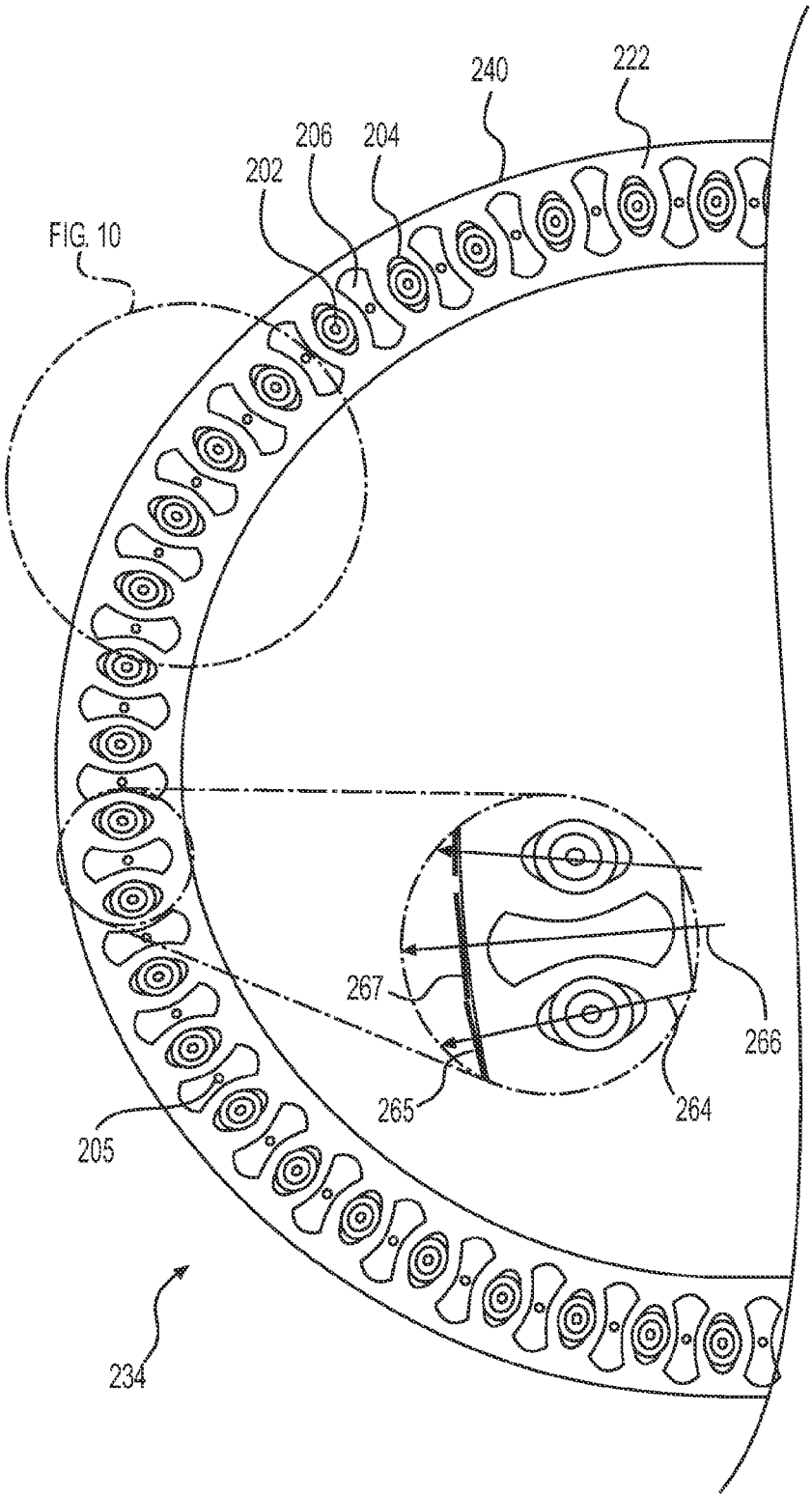
FIG. 9 is a schematic diagram of a semi-circular portion of the braiding machine of FIG. 8.

FIG. 9 is an expanded view of a semi-circular portion 234 of braiding machine 200 of FIG. 8, showing the disposition of spools 202, oval carriages 204 and rotor metals 206 at the semi-circular portion 234 of the braiding machine. Rotor metals 206 may be rotated by shafts 205. In each case, the central axis 266 of each rotor metal 206, when it is at rest, is oriented in a direction that is normal to the tangent 267 of the outer perimeter 240 at that position of the braiding machine 200, and the central axis 264 of each oval carriage 204 is oriented in a direction that is normal to the tangent 265 of the outer perimeter 240 at that position of the braiding machine. Because the oval carriages 204 are located at different positions around the perimeter of track 222 than the metal rotors 206, and because the perimeter of track 222 is curved, the orientation of the central axes of the oval carriages are at a small angle to the orientation of their adjoining rotor metals, as shown in the blow-up in FIG. 9. For that reason, the spacing between rotor metals around track 222 may be selected to be somewhat larger than if the perimeter was linear, to accommodate this difference in orientation.

Figure 10:
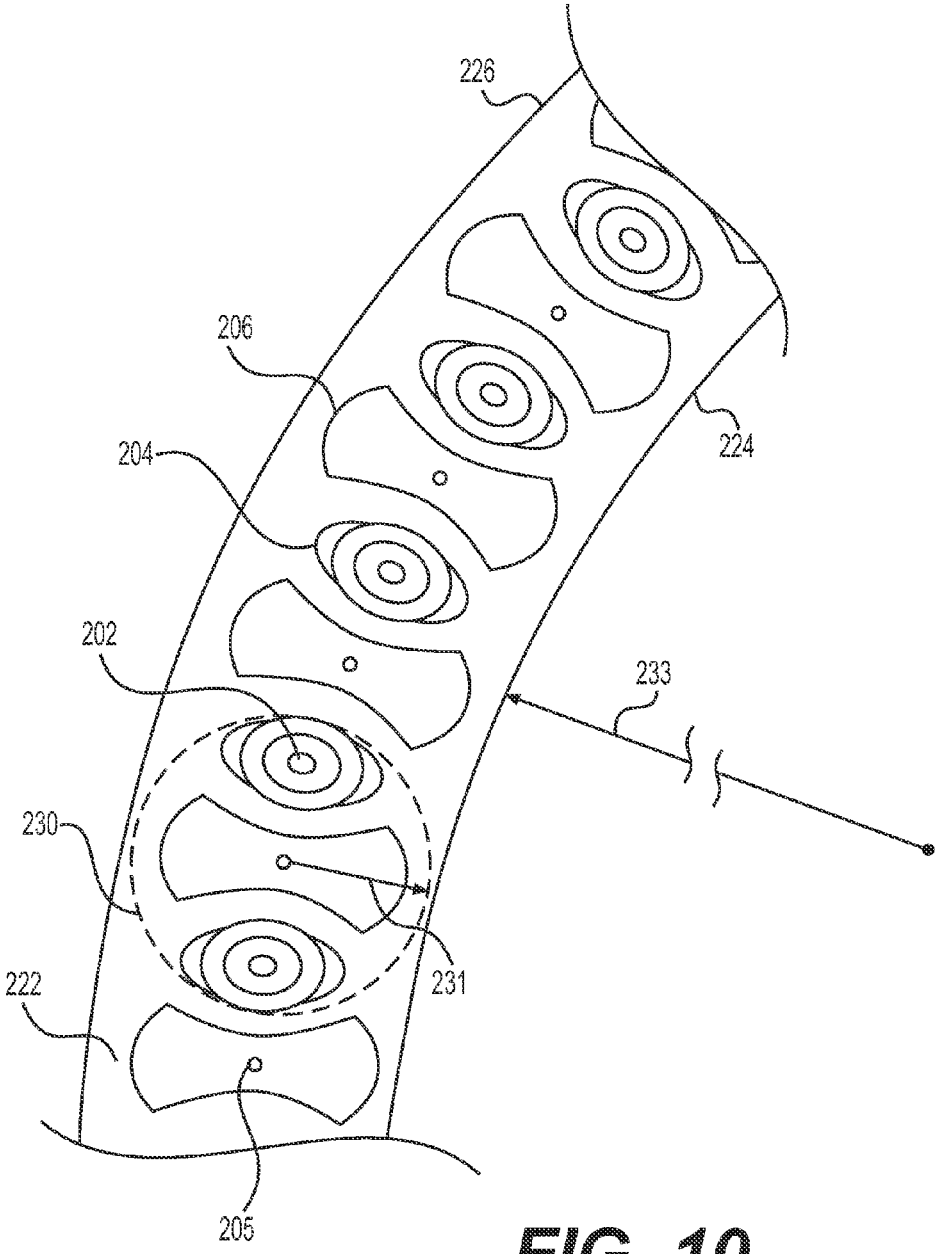
FIG. 10 is an expanded view of a part of the semi-circular portion of the lace braiding machine of FIG. 8.

FIG. 10 is a schematic diagram of an expanded view of the portion of FIG. 9 identified by the notation "FIG. 10." In this expanded view, a dotted circle 230 encompasses a rotor metal 206 and its two adjoining carriages 204, which carry spools 202. This circle 230 may be referred to herein as a "sweeping circle," and is characterized by a radius 231. When the rotor metal 206 is rotated by shaft 205, for example by 180°, its adjoining carriages 204 are swept around within dotted circle 230 and exchange positions. This schematic diagram shows that carriages 204 are constrained by exterior wall 224 and interior wall 226 of track 222, so that when rotor metals 206 are rotated, the carriages are swept around within the dotted circle and exchange positions. A limiting factor in the configuration of a lace braiding machine is that the ratio of the radius of curvature of a given portion of a lace braiding machine to the radius of the sweeping circle should be sufficiently large that the rotor metals can effectively sweep the oval carriages within the sweeping circle. For example, in some embodiments, the ratio of the radius of curvature 233 of the portion of the inner perimeter of the lace braiding machine that has the smallest radius of curvature to the radius 231 of the sweeping circle is at least 5:1. In other embodiments the ratio is at least 7:1, at least 8:1 or at least 10:1.

Figure 11:
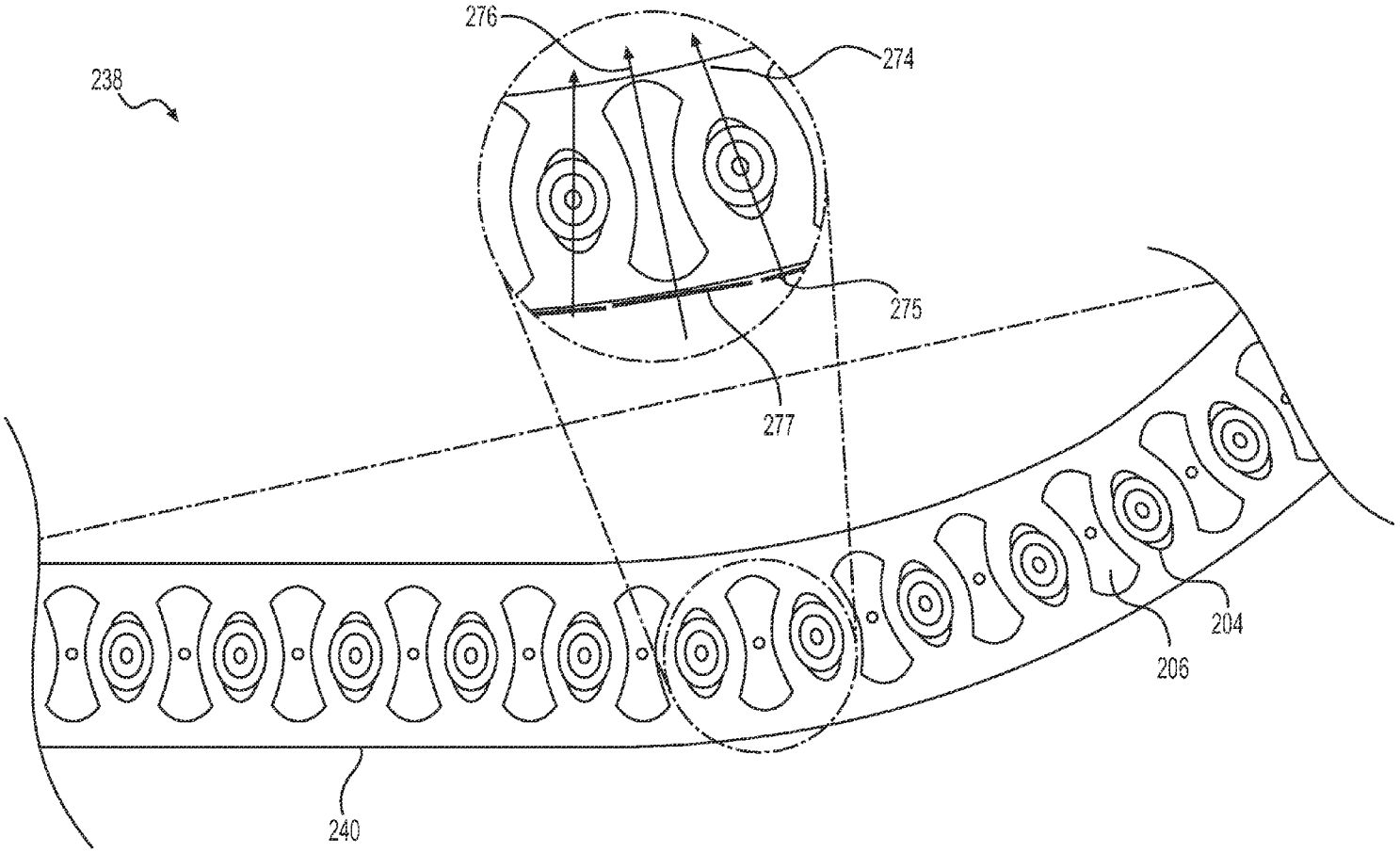
FIG. 11 is a schematic diagram of a transition portion of the braiding machine of FIG. 8.

FIG. 11 is an expanded view of the transition portion 238 from a semi-circular portion 234 to a linear portion 236 of braiding machine 200, showing the disposition of spools, oval carriages, shafts and rotor metals in the transition region. As in the semicircular portion described above with reference to FIG. 6, the central axis 276 of each rotor metal 206, when it is at rest, is oriented in a direction that is normal to the tangent 277 of the outer perimeter 240 at that position of the braiding machine 200, and the central axis 274 of each oval carriage 204 is oriented in a direction that is normal to the tangent 275 of the outer perimeter 240 at that position of the braiding machine. In the transition region, however, the difference in orientation between the central axis 276 of the rotor metal and the orientation of the central axis 274 of its adjoining oval carriages 204 may not be as great as in the semi-circular portion 234. For that reason, a smaller spacing between rotor metals and oval carriages around track 222 in the transition region may be used, compared to the spacing used in the semi-circular region.

Figure 12:
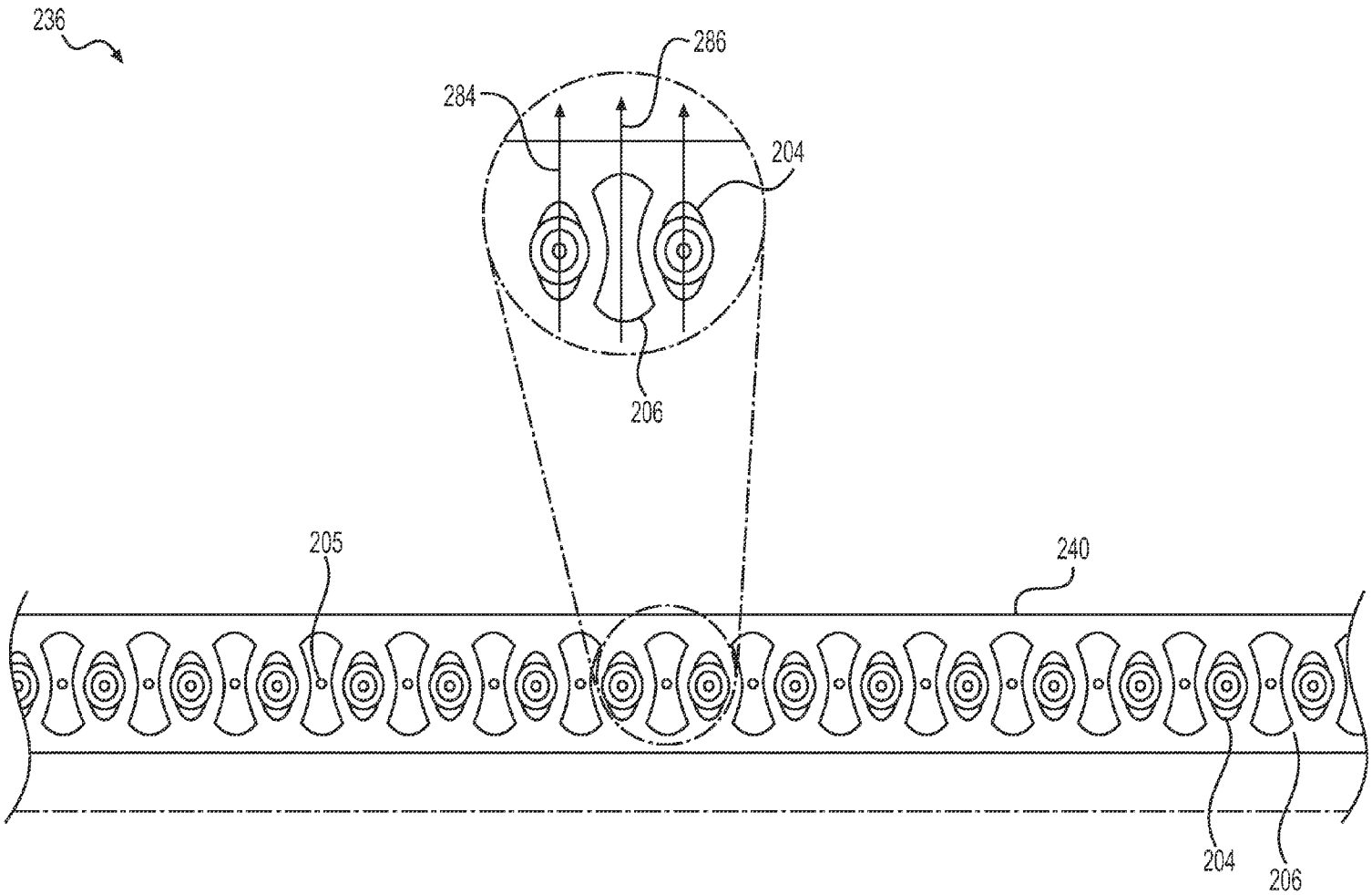
FIG. 12 is a schematic diagram of a linear portion of the braiding machine of FIG. 8.

FIG. 12 is an expanded view of a linear portion 236 of braiding machine 200, showing the disposition of spools, oval carriages, shafts, and rotor metals in the linear region. In this case, the central axis 286 of each rotor metal 206, when it is at rest, is oriented in a direction that is parallel to the central axis 284 of its adjoining oval carriages 204. Thus in the linear region, the spacing between rotor metals and oval carriages around track 222 may be smaller than in the other regions. This may allow for a somewhat denser packing of rotor metals, oval carriages and spools in the linear region of the braiding machine. This may have the advantage of possibly increasing the number of spools that may be disposed around the perimeter of the braiding machine.

Figure 13:
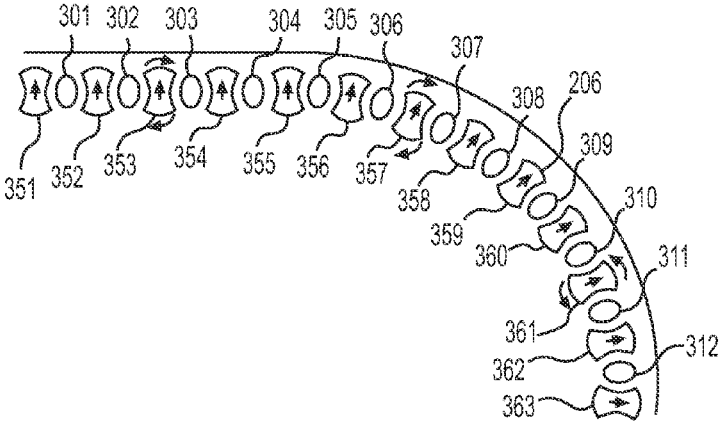
FIGS. 13-15 are schematic diagrams illustrating the operation of a braiding machine that has a racetrack configuration.
Figure 14:
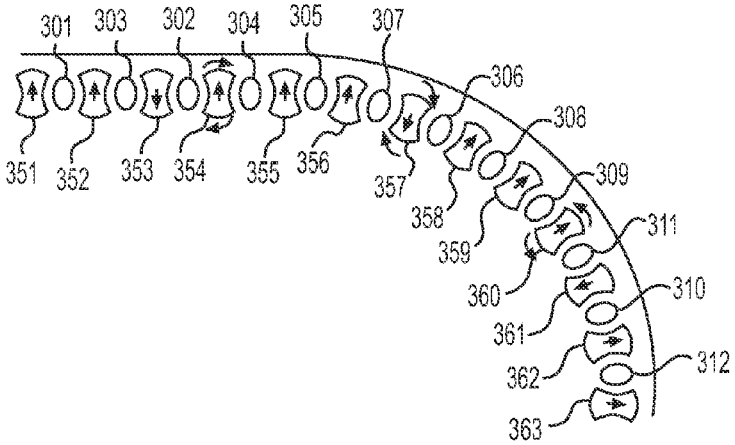
Figure 15:
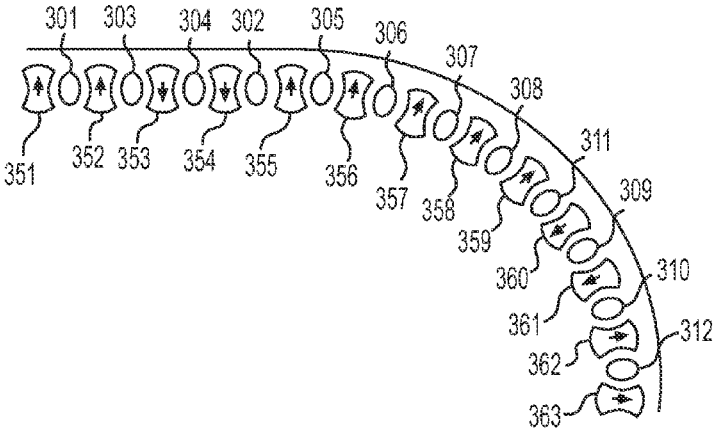

FIGS. 13-15 illustrate examples of how the rotor metals may be rotated to (1) twist tensile elements around each other and/or (2) move carriages from one position to another in an embodiment of a braiding machine. In FIGS. 13-15, rotor metal 351, rotor metal 352, rotor metal 353, rotor metal 354, rotor metal 355, rotor metal 356, rotor metal 357, rotor metal 358, rotor metal 359, rotor metal 360, rotor metal 361, rotor metal 362 and rotor metal 363 are disposed around a portion of the perimeter of a braiding machine. Oval carriage 301, oval carriage 302, oval carriage 303, oval carriage 304, oval carriage 305, oval carriage 306, oval carriage 307, oval carriage 308, oval carriage 309, oval carriage 310, oval carriage 311 and oval carriage 312 are disposed between pairs of rotor metals.

As discussed above with reference to FIGS. 9-12, the difference in the curvature of the perimeter of the track 322 in different portions of the racetrack can be accommodated by providing a sufficient spacing between rotor metals. Thus in some embodiments, the spacing between rotor metal 351 and rotor metal 352, for example, in the linear portion 323 of track 322 may be somewhat closer than the spacing between rotor metal 356 and rotor metal 357 in the transition portion 324 of racetrack 322, which in turn may be somewhat closer than the spacing between rotor metal 360 and rotor metal 361, for example, in the semi-circular portion 325 of track 322.

When a given rotor metal is rotated 180°, either clockwise or counter-clockwise, its adjoining carriages exchange places. For example, FIG. 13 shows that rotor metal 353 is about to be rotated clockwise, thus exchanging the positions of carriage 302 and carriage 303, as shown in FIG. 14; the rotation of rotor metal 357 exchanges the positions of carriage 306 and carriage 307, as shown in FIG. 14; and the rotation of rotor metal 361 exchanges the positions of carriage 310 and carriage 311, as shown in FIG. 14.

These actions may be repeated to twist tensile elements around each other and/or to move spools to different positions around the perimeter. For example, FIG. 14 and FIG. 15 show that the rotation of rotor metal 354 by 180° exchanges the positions of carriage 302 and carriage 304, as shown in FIG. 15; the rotation of rotor metal 357 exchanges the positions of carriage 306 and carriage 307, returning them to their original positions, as shown in FIG. 15; and the rotation of rotor metal 360 exchanges the positions of carriage 309 and carriage 311, as shown in FIG. 15. Thus the sequence of rotations from FIG. 13 to FIG. 15, in addition to twisting tensile elements from adjoining spools around each other, has served to move carriage 302 two positions to the right, and carriage 303 and 304 each one position to the left. Carriage 306 and carriage 307 have returned to their original positions. Carriage 311 has moved two positions to the left, while carriage 309 and carriage 310 have moved one position to the right.

This procedure may be carried out many times, thus twisting tensile elements around each other and advancing carriages and the spools carried on these carriages to any selected position around the perimeter. Spools that carry tensile elements that have different properties, such as dimensions, color, strength, elasticity, resilience, abrasion-resistance and/or other properties may be moved from one position to another position in order to fabricate a braided structure with a particular design.

The greater the number of spools, the faster the throughput of the machines and/or the greater braid density that can be achieved. The throughput could be increased because the more tensile elements that may be applied to an object such as a last, form or mandrel for a given unit of time, the faster the object can move through the braiding machine. The braid density could be increased because more tensile elements may be applied to the object from the greater number of spools.

Figure 16:
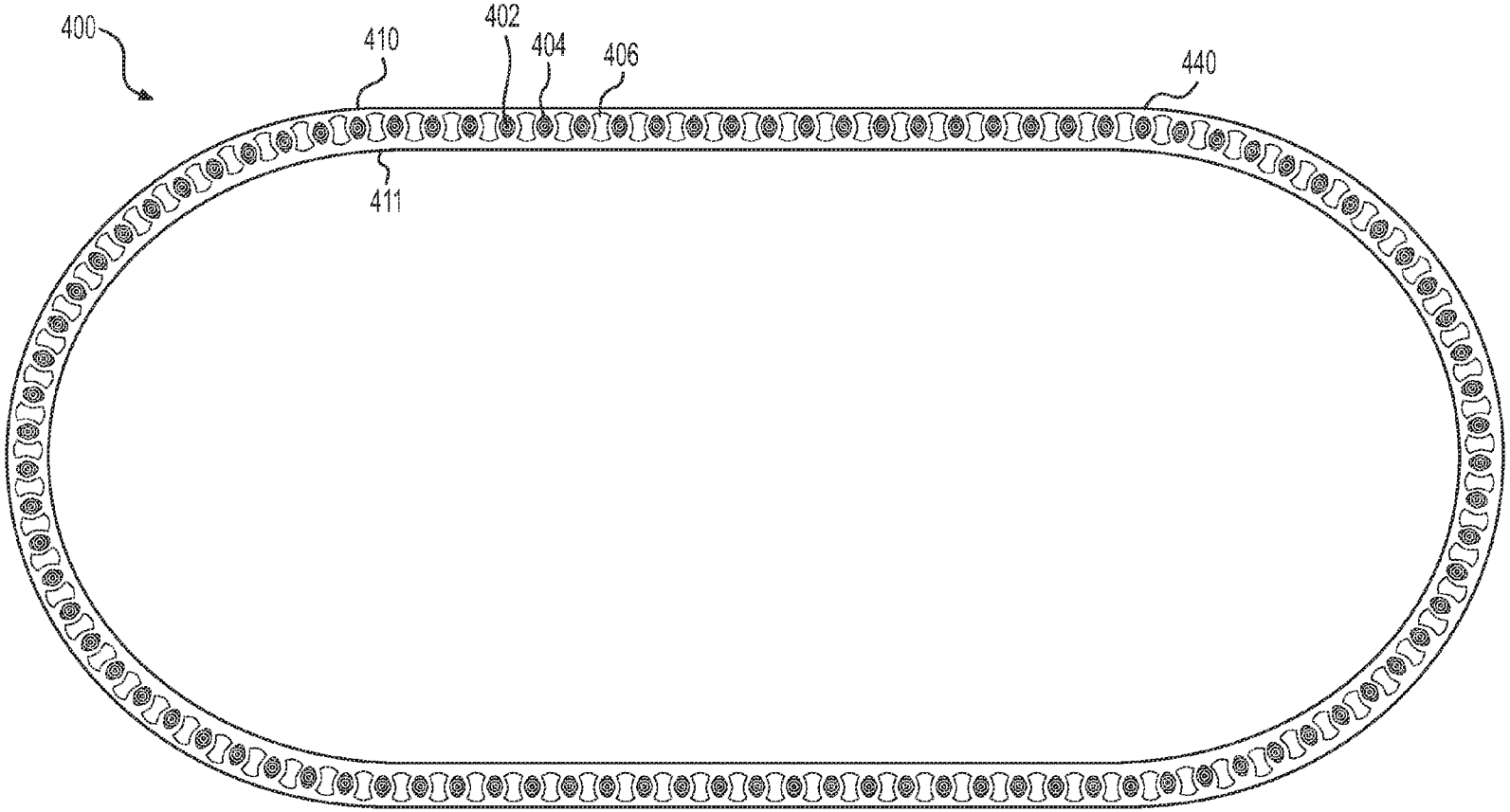
FIG. 16 is a schematic diagram of a braiding machine with a racetrack configuration that can accommodate one hundred sets of rotor metals, carriages and spools.
Figure 17:
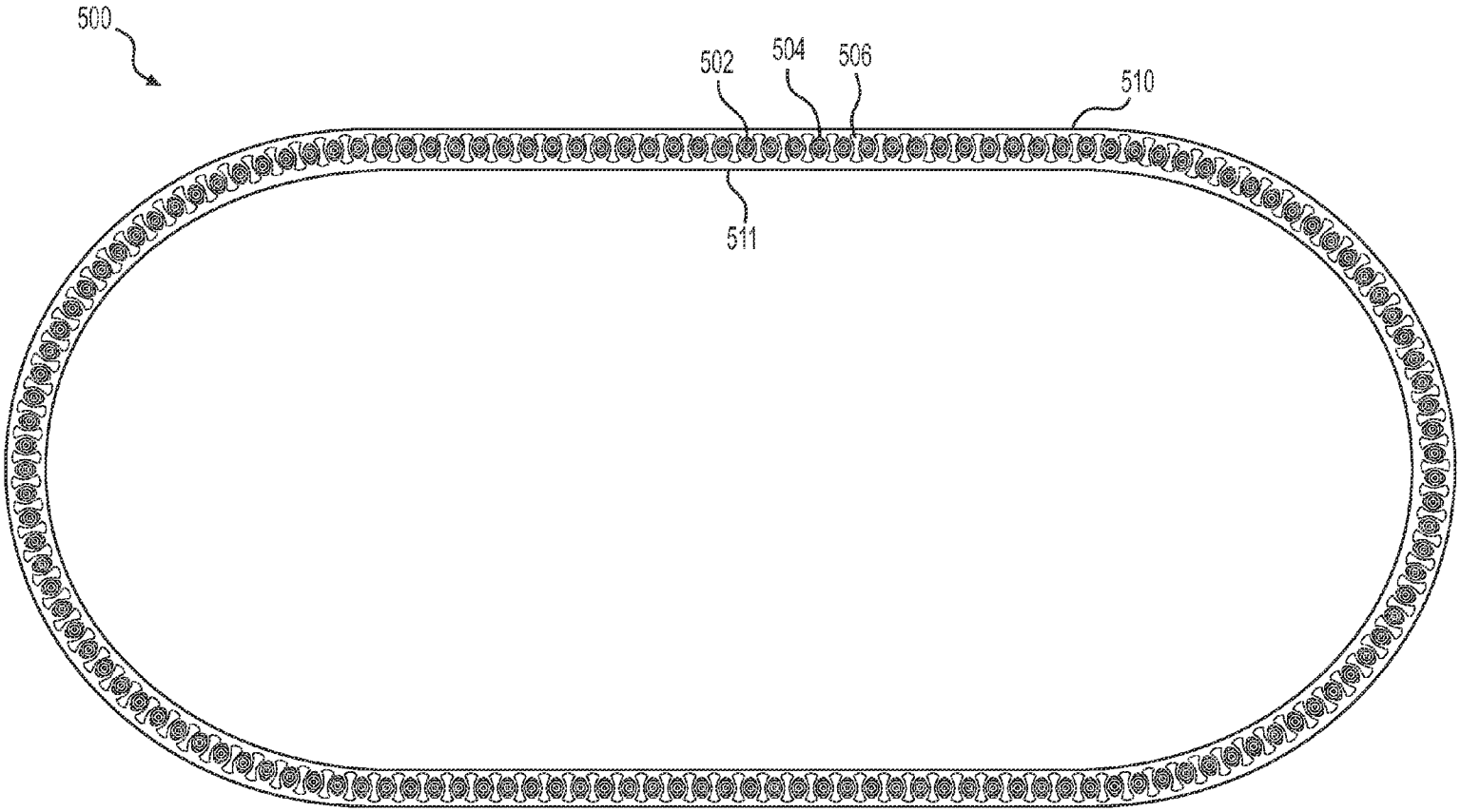
FIG. 17 is a schematic diagram of a braiding machine with a racetrack configuration that can accommodate one hundred and forty-six sets of rotor metals, carriages and spools.

Embodiments of the braiding machine may accommodate greater numbers of sets of spools/carriages/rotor metals than shown in FIG. 1. For example, braiding machines may have at least 96 sets of spools, carriages, and rotor metals, or at least 144 spools/carriages/rotor metals. FIG. 16 illustrates a racetrack embodiment of a braiding machine (shown for clarity without any apparatus at the interior of the machine) that can accommodate 100 sets of spools 402, carriages 404 and rotor metals 406. Braiding machine 400 has an outer perimeter 440. The rotor metals and the carriages are confined within the rotor track by exterior wall 410 and interior wall 411. FIG. 17 illustrates a racetrack embodiment of a braiding machine 500 (shown for clarity without any apparatus at the interior of the machine) that can accommodate 146 sets of spools 502, carriages 504 and rotor metals 506. The rotor metals and the carriages are confined within the rotor track by exterior wall 510 and interior wall 511.

Figure 18:
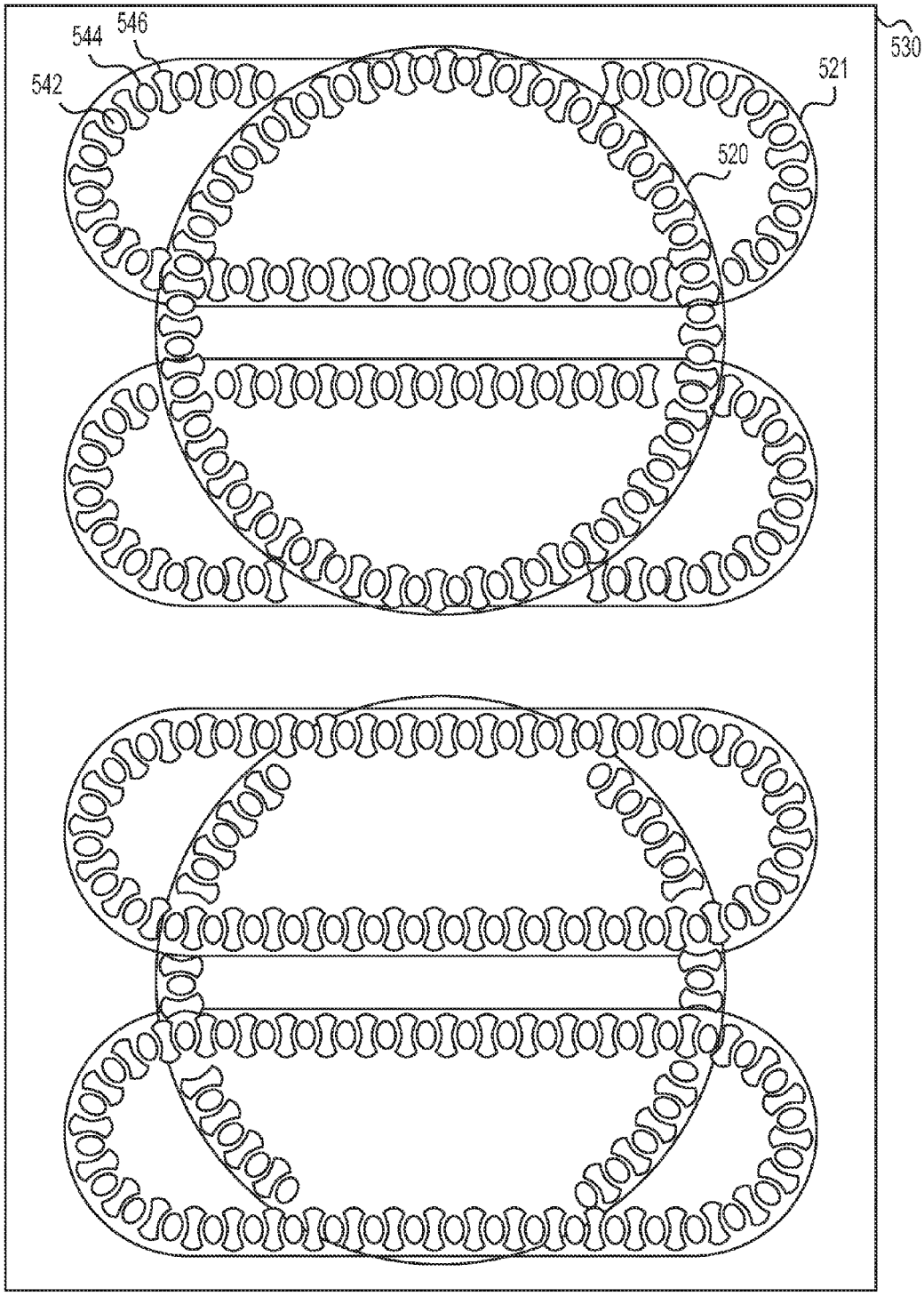
FIG. 18 is a schematic diagram comparing the floor space used by racetrack braiding machines to the floor space used by circular braiding machines.

FIG. 18 is a schematic diagram comparing the floor space used by braiding machines that have a racetrack configuration to the floor space used by braiding machines that have a circular configuration. In the example shown in FIG. 18, the floor space 530 is rectangular, and the perimeter of each braiding machine has approximately the same length. Although not shown for clarity, in operation spools would be mounted on the top surfaces 542 of oval carriages 544. Because the perimeters have the same length, each braiding machine can support the same number of oval carriages 544 and rotor metals 546 as the other braiding machines. In the example shown in FIG. 18, each of the braiding machines can support 40 spools. Since four racetrack braiding machines 521 fit within the same floor space as two circular braiding machines 520, FIG. 18 shows that twice as many spools can be used with racetrack braiding machines as can be used with circular braiding machines. In other words, racetrack braiding machines are twice as efficient in their use of floor space as circular braiding machines, and therefore enable twice the production rate of braided articles.

Embodiments of braiding machines may be characterized by comparing the longest distance from any spool on the perimeter of the braiding machine to the braid point to the shortest distance from any spool on the perimeter of the braiding machine to the braid point. In some embodiments, the longest distance is substantially greater, for example at least 20% greater, than the shortest distance.

Figure 19:
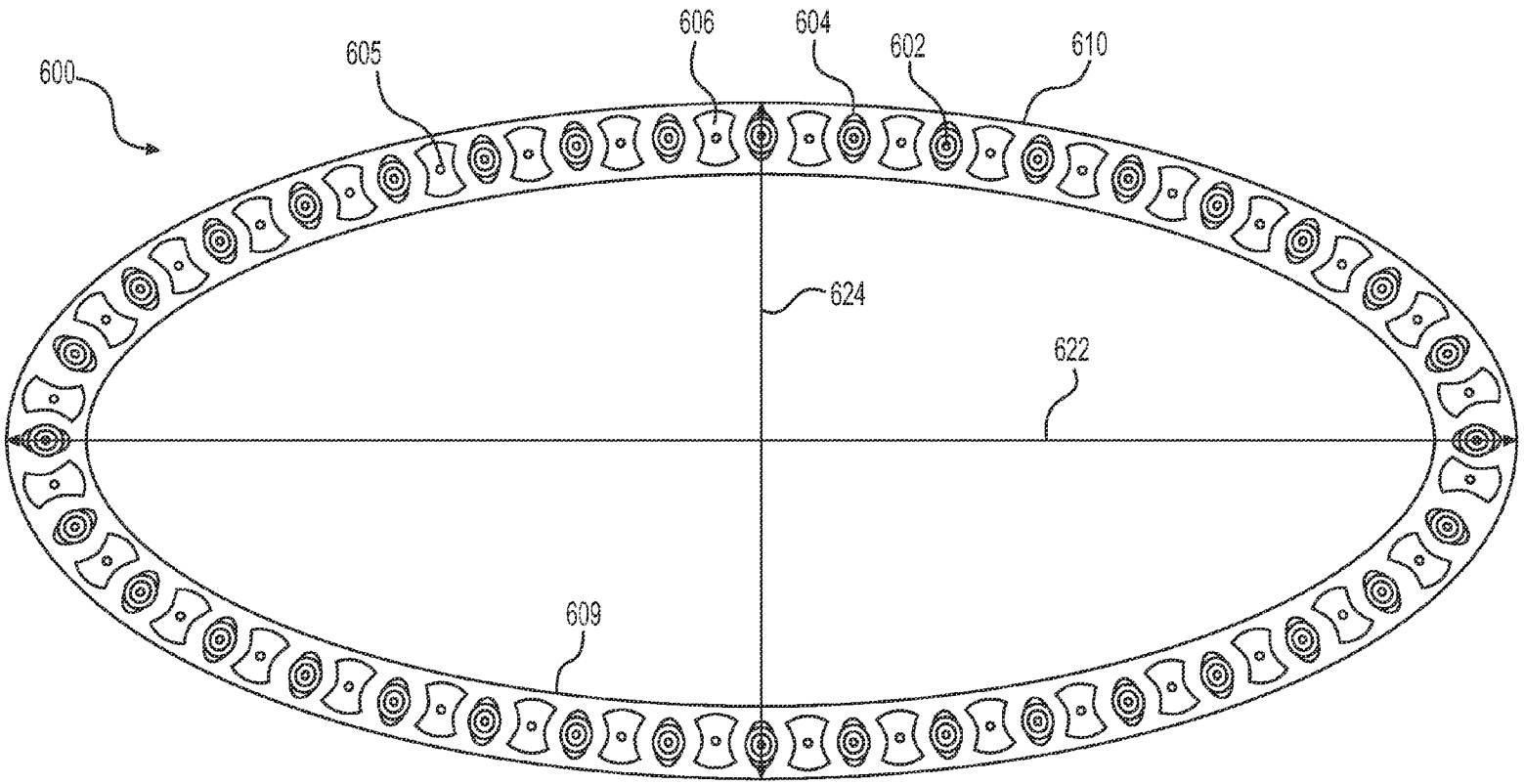
FIG. 19 is a schematic diagram of a braiding machine with an oval configuration.

Embodiments of the braiding machine may have other shapes, such as the shapes in the examples described below with reference to FIGS. 19-25. Thus FIG. 19 is an example of an embodiment of a braiding machine 600 that forms a simple convex closed curve and has an oval or elliptical shape. In these embodiments, the radius of curvature of the portion of the oval that has the greatest radius of curvature is substantially greater than the radius of curvature of the portion of the oval that has the smallest radius of curvature. In this case, "substantially" means at least five times greater. Braiding machine 600 has spools 602 mounted on carriages 604 that are positioned between rotor metals 606 that maybe rotated by shafts 605 between the outer perimeter 610 and the inner perimeter 609 of the braiding machine. In some embodiments, the ratio of the length of the major axis 622 of the ellipse forming the outer perimeter 610 to the length of the minor axis 624 of the ellipse forming the outer perimeter 610 could be in the range of about 1.5:1, or 2:1 or more.

Figure 20:
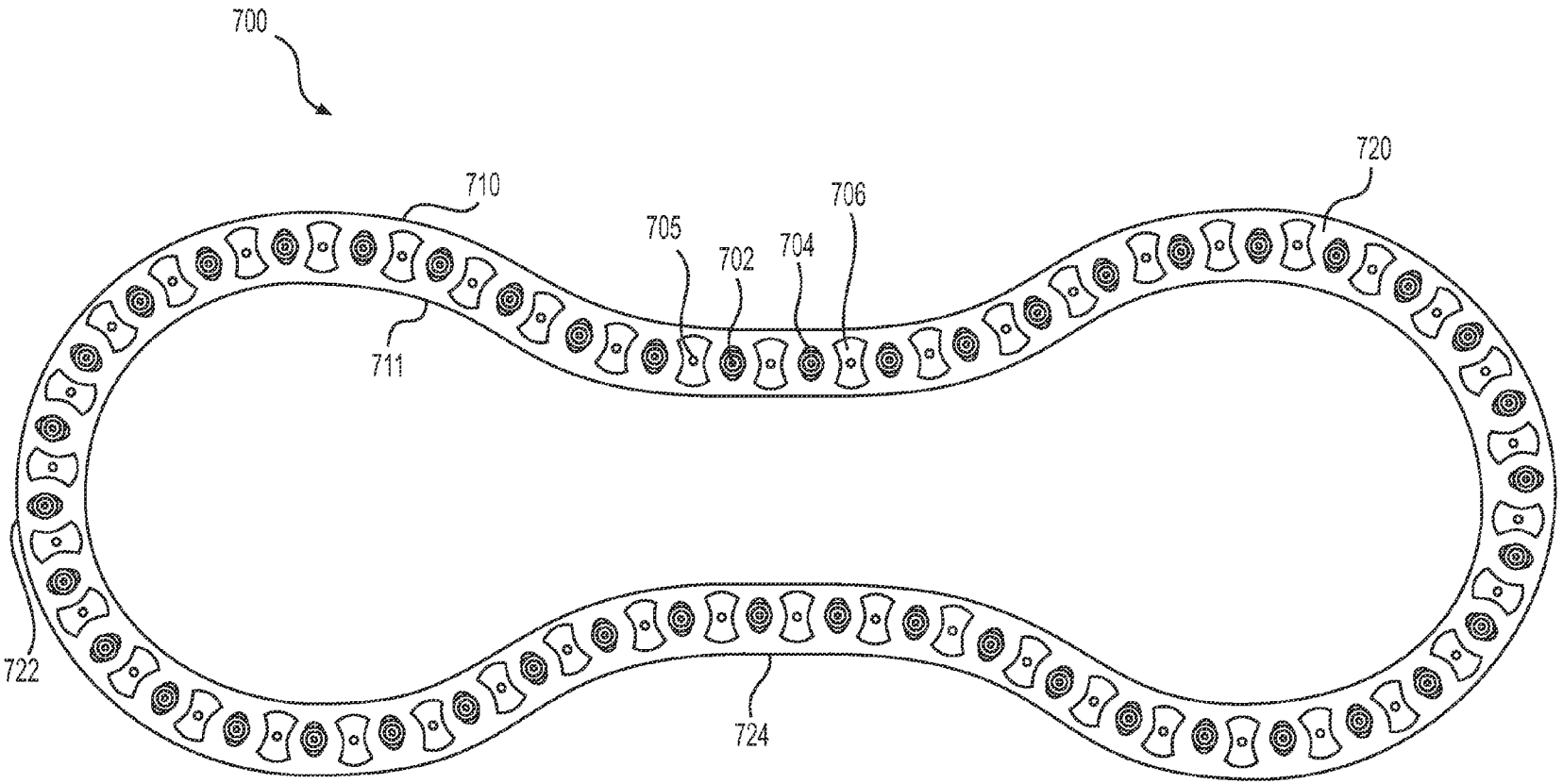
FIG. 20 is a schematic diagram of a plan view of a braiding machine that has convex and concave portions.

The possible configurations of braiding machines are not limited to machines that have a perimeter with only convex or linear portions. For example, embodiments of the braiding machine may have concave portions as well as convex portions and/or linear portions. Examples of such embodiments are shown in FIG. 20, FIG. 23, FIG. 24 and FIG. 25. FIG. 20 is an embodiment of braiding machine 700 that has two convex and generally semi-circular end portions 722 and two concave portions 724. This example has forty-six sets of spools 702 mounted on carriages 704 which are disposed between adjoining rotor metals 706 on track 720. The carriages 704 are constrained by outer perimeter wall 710 and inner perimeter wall 711, such that they can be swept around by rotor metals 706 when they are rotated by shafts 705.

Figure 21:
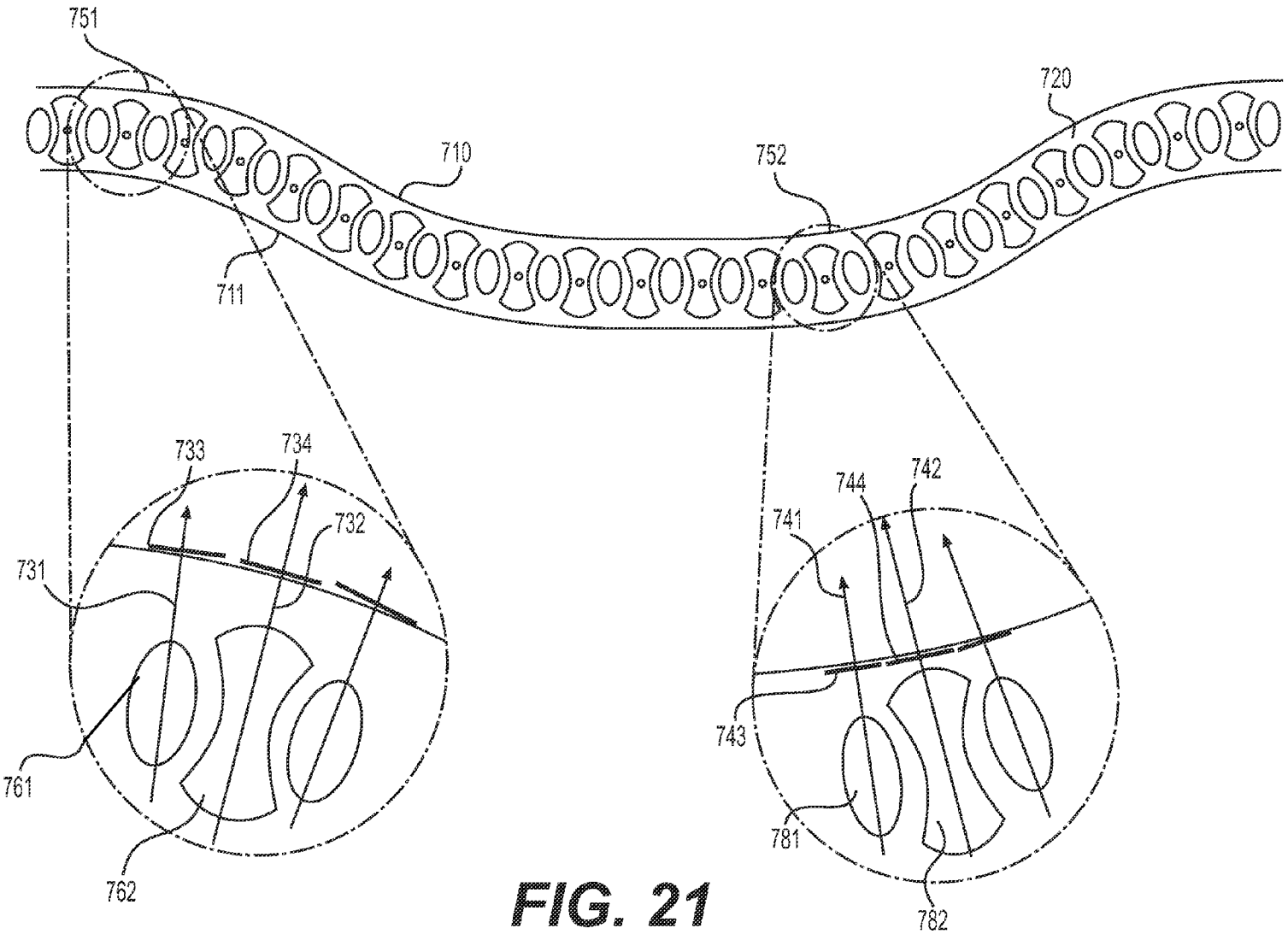
FIG. 21 is an expanded view of a portion of the braiding machine of FIG. 20.

FIG. 21 is a schematic diagram showing a portion of track 720 of an embodiment of a braiding machine that has a convex portion 751 and a concave portion 752. In the blow-up of convex portion 751, the orientation of oval carrier 761 is shown by directional arrow 731, which is normal to the tangent 733 to the outer perimeter of track 720 at that point. The orientation of rotor metal 762 is shown by directional arrow 732, which is normal to the tangent 734 to the outer perimeter of track 720 at that point. In this convex portion of the track, adjoining ovals and rotor metals are angled away from each other (in the direction of the outer perimeter). In the blow-up of concave portion 752, the orientation of oval carrier 781 is shown by directional arrow 741, which is normal to the tangent 743 to the outer perimeter of track 720 at that point. The orientation of rotor metal 782 is shown by directional arrow 742, which is normal to the tangent 744 to the outer perimeter of track 720 at that point. In this concave portion of the track, adjoining ovals and rotor metals are angled towards each other (in the direction of the outer perimeter). Because adjoining rotor metals and oval carriers are not perfectly aligned, the differences in their orientations must be accounted for in the configuration of the braiding machine. For example, to accommodate this difference in orientation of rotor metals and oval carriers in both the convex portions and the concave portions of the track, additional space may be provided between each rotor metal and its adjoining oval carriers to allow for a smooth rotation of the rotor metals.

Figure 22:
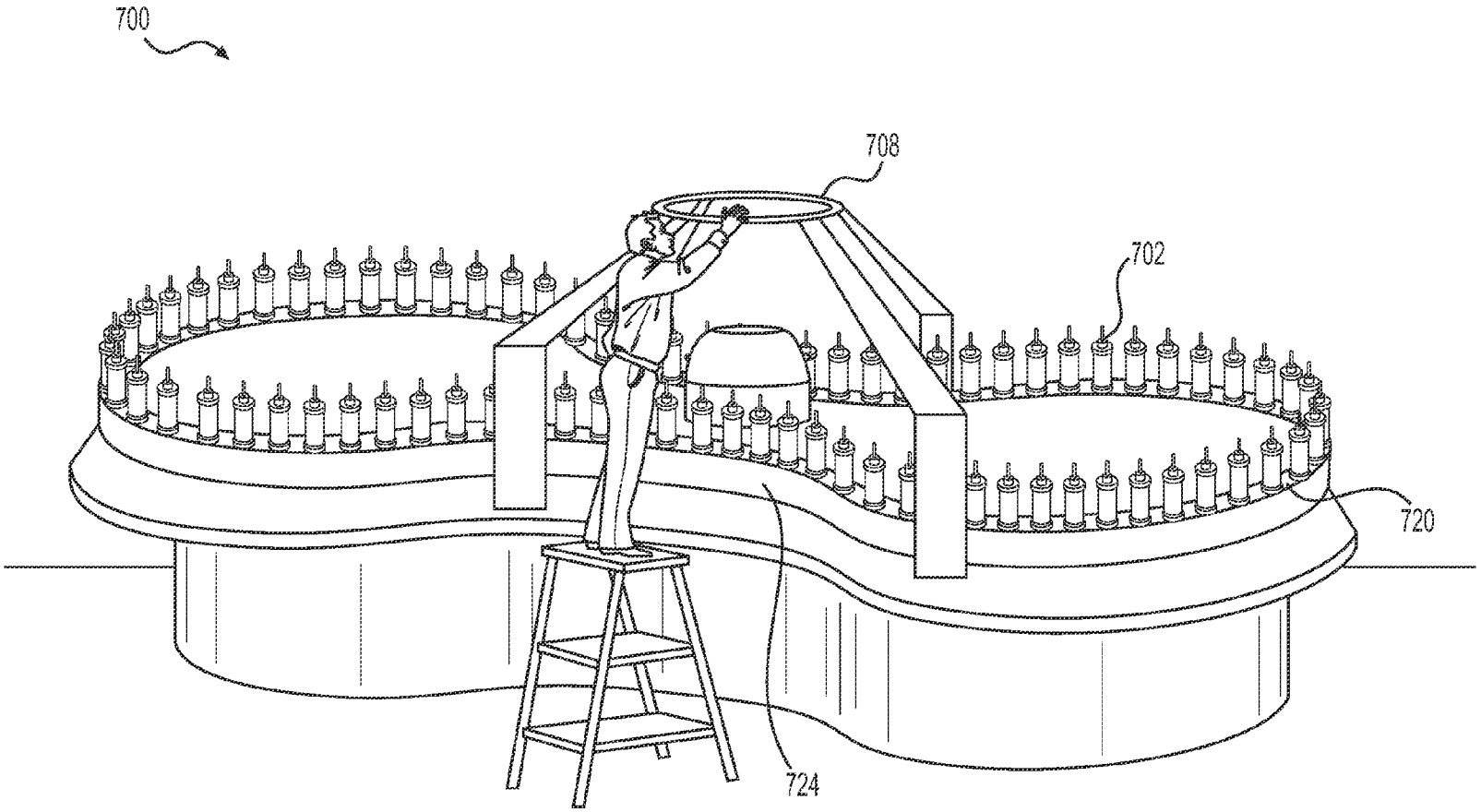
FIG. 22 is a perspective schematic diagram of the braiding machine shown in plan view in FIG. 20.

FIG. 22 is a perspective view of the braiding machine 700 shown in plan view in FIG. 20 showing spools 702 disposed around track 720. FIG. 22 includes an illustration of a workman making an adjustment to ring 708. The workman is standing on a ladder positioned next to concave portion 724 of track 720, where he can more easily reach ring 708. Thus the embodiment of FIG. 20 has the advantage of providing workmen and technicians greater access to the apparatus in the middle of the braiding machine so that they can perform any necessary maintenance or adjustments to that apparatus.

Figure 23:
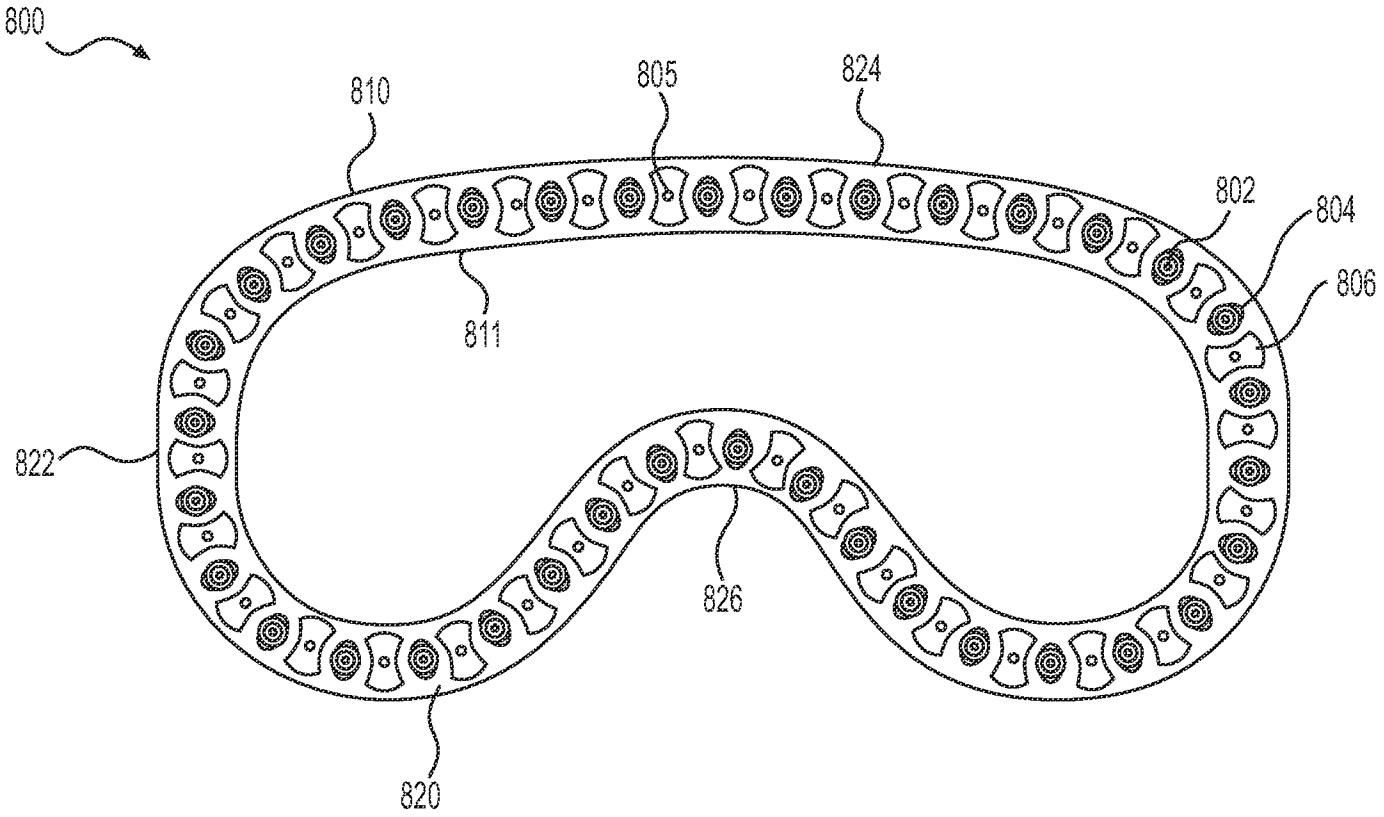
FIG. 23 is a schematic diagram of a plan view of a braiding machine that has a linear portion, two convex portions and one concave portion.

FIG. 23 is an embodiment of a braiding machine 800 with a track 820 that forms a simple closed curve which has two curved convex portions 822 at opposite ends that are joined by a linear portion 824 on one side and by a concave portion 826 on the other side. Rotor metals 806 (which may be rotated by shafts 805), oval carriages 804 and spools 802 are disposed around track 820, and are confined by inner wall 811 and outer wall 810. Concave portion 826 provides greater access for workmen to any devices in the middle of the braiding machine so that they can perform any necessary maintenance or adjustments.

Figure 24:
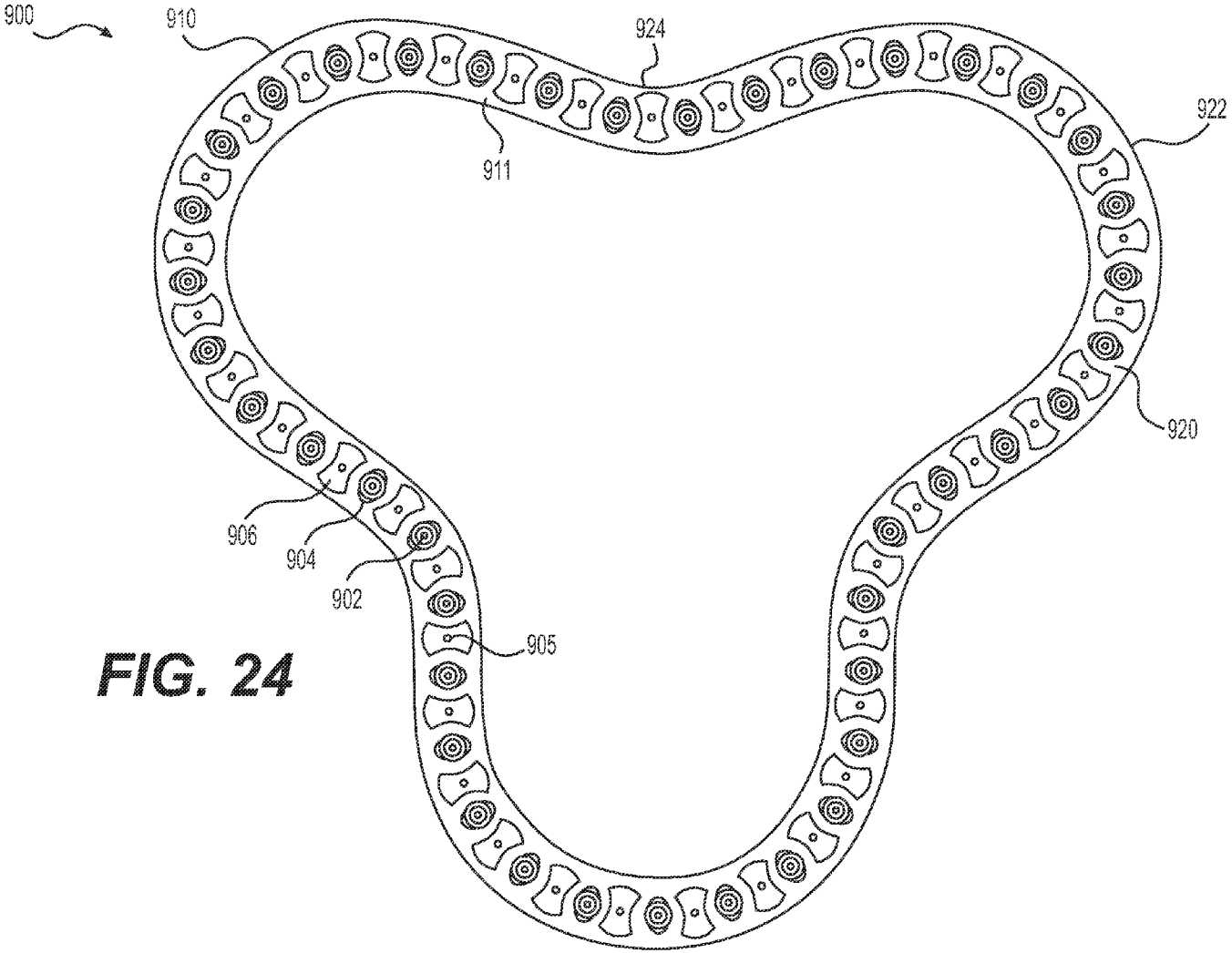
FIG. 24 is a schematic diagram of a plan view of a braiding machine that has three convex portions and three concave portions.

FIG. 24 is an embodiment of a braiding machine 900 that has three-fold symmetry. It is a simple closed curve that has three convex portions 922 which are joined by three concave portions 924. Rotor metals 906, oval carriages 904 and spools 902 are disposed on track 920, which is bounded by outer perimeter wall 910 and inner perimeter wall 911. This configuration may allow closer access to any apparatus in the middle of the braiding machine from three different sides of the machine.

Figure 25:
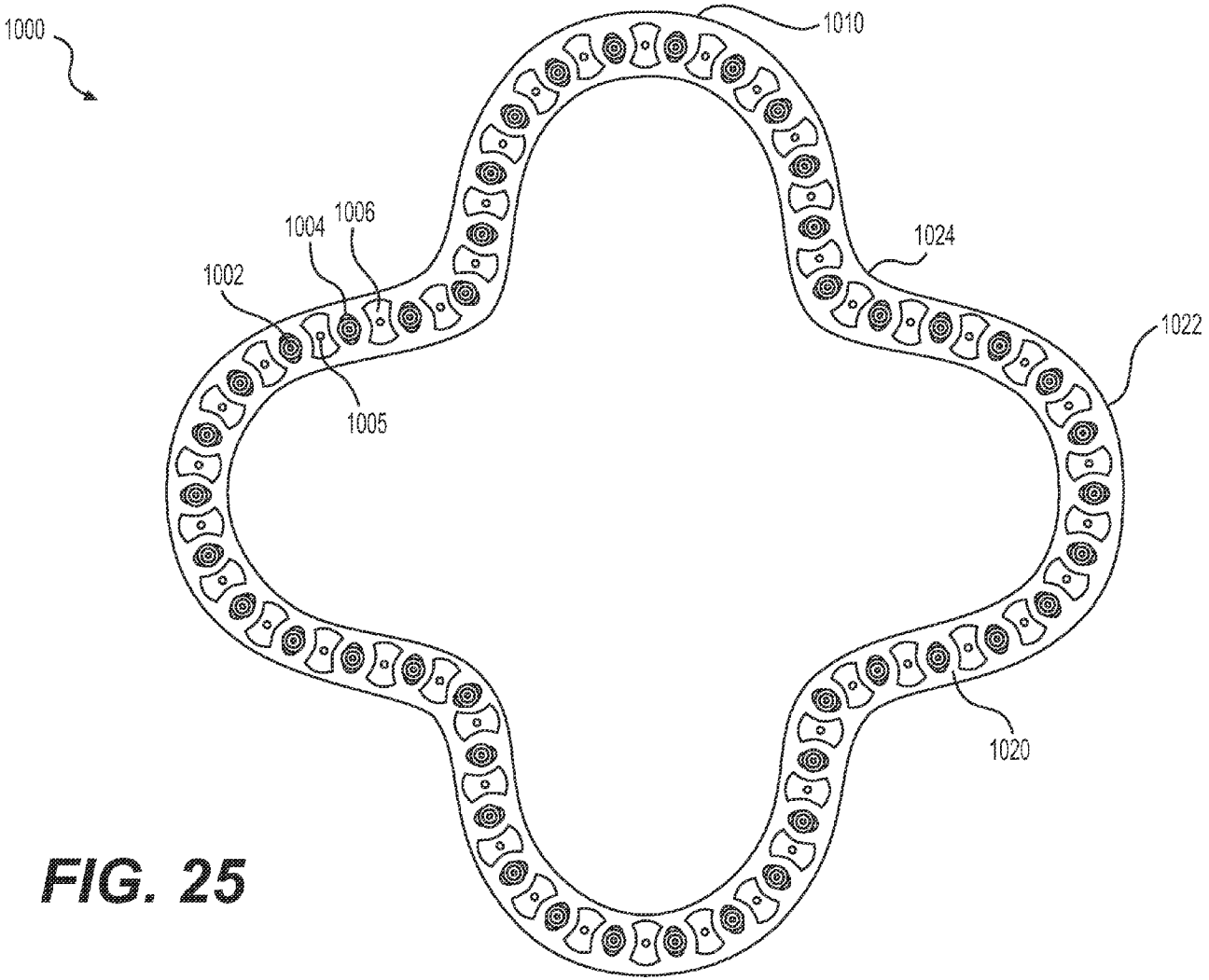
FIG. 25 is a schematic diagram of a plan view of a braiding machine that has four convex portions and four concave portions.

FIG. 25 is an embodiment of a braiding machine 1000 that has four-fold symmetry. It is a simple closed curve that has four convex portions 1022 which are joined by four concave portions 1024. Rotor metals 1006 with their shafts 1005, oval carriages 1004 and spools 1002 are disposed around track 1020, within outer perimeter wall 1010 of track 1020. This configuration may allow closer access to any apparatus in the middle of the braiding machine from four different sides of the braiding machine.

Figure 26:
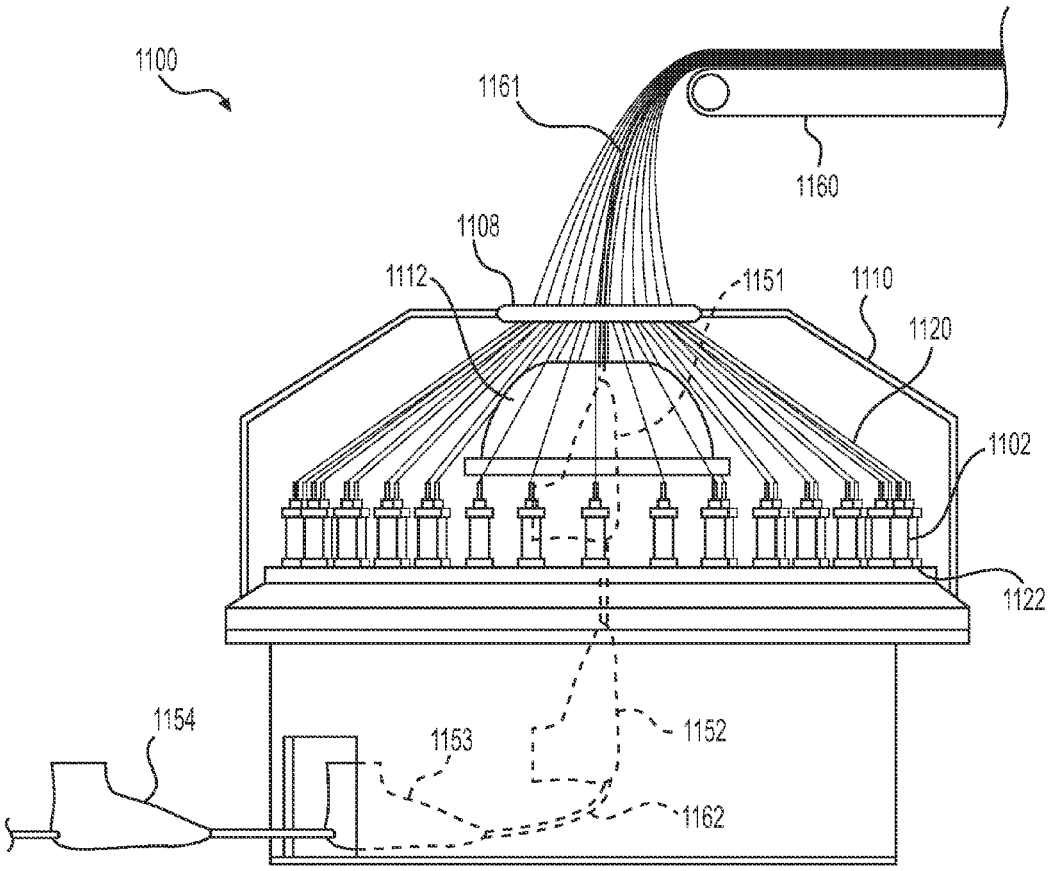
FIGS. 26-30 are schematic diagrams of an end view of a braiding machine illustrating forms being braided over as they are passed through the machine.
Figure 27:
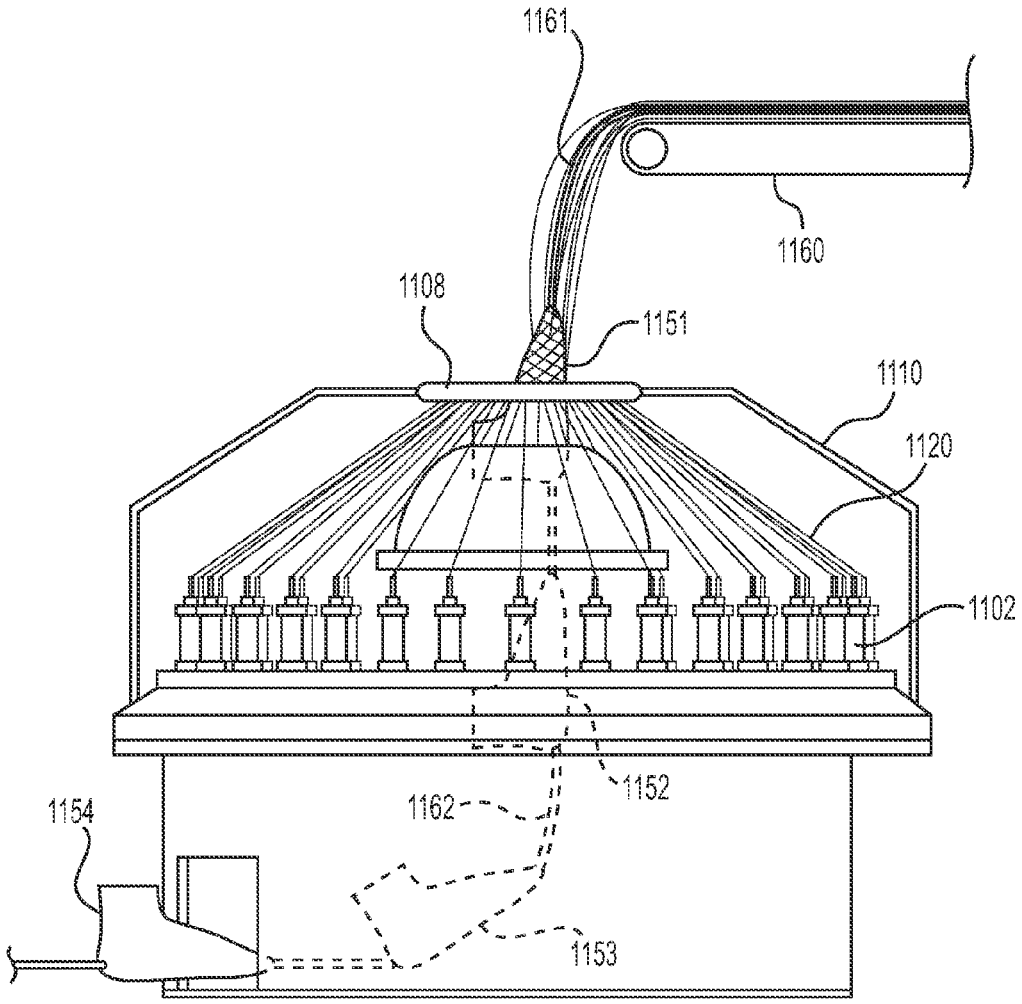
Figure 28:
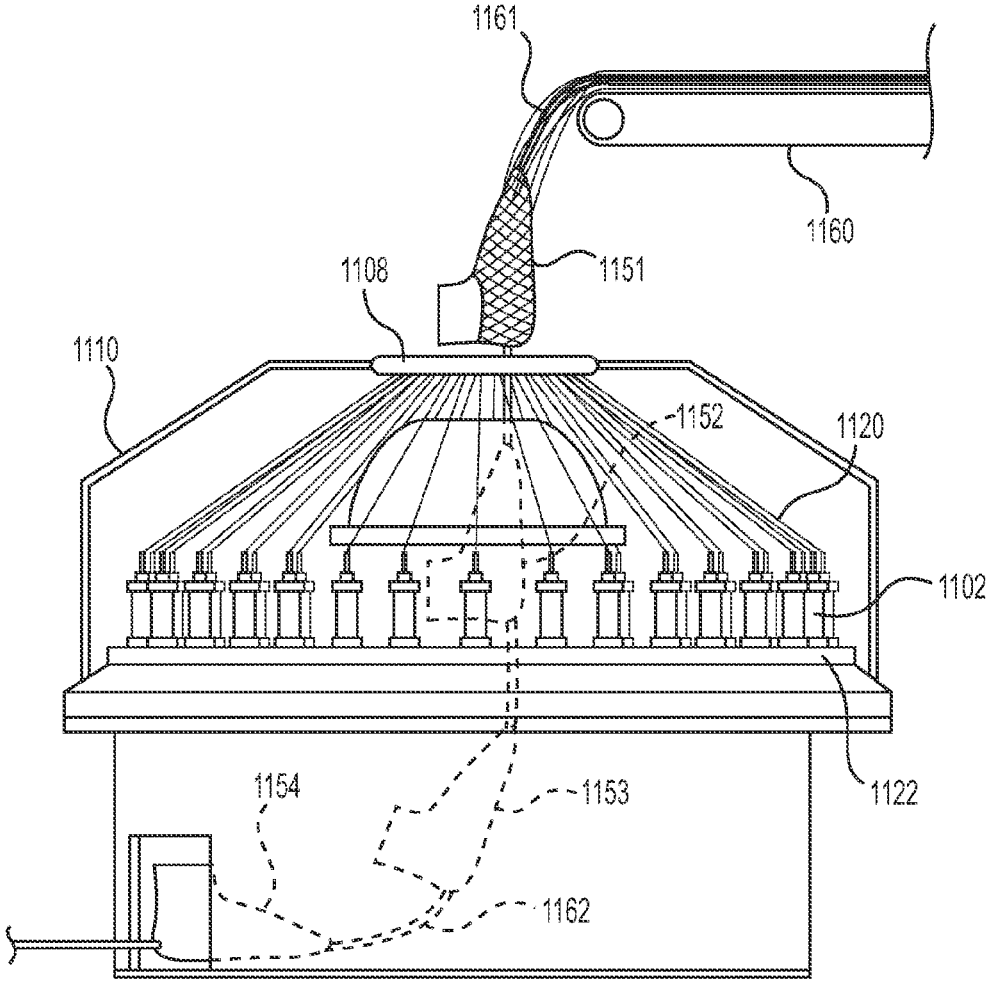
Figure 29:
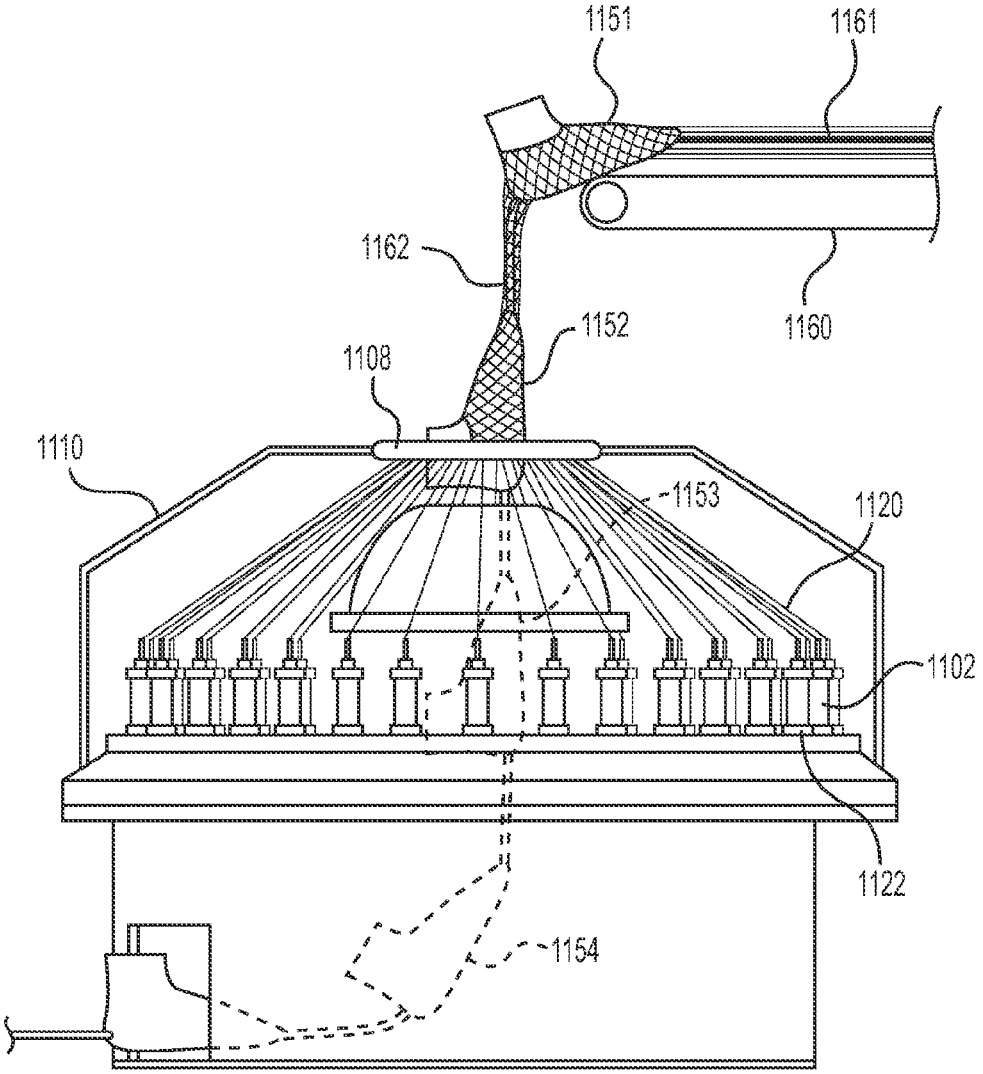
Figure 30:
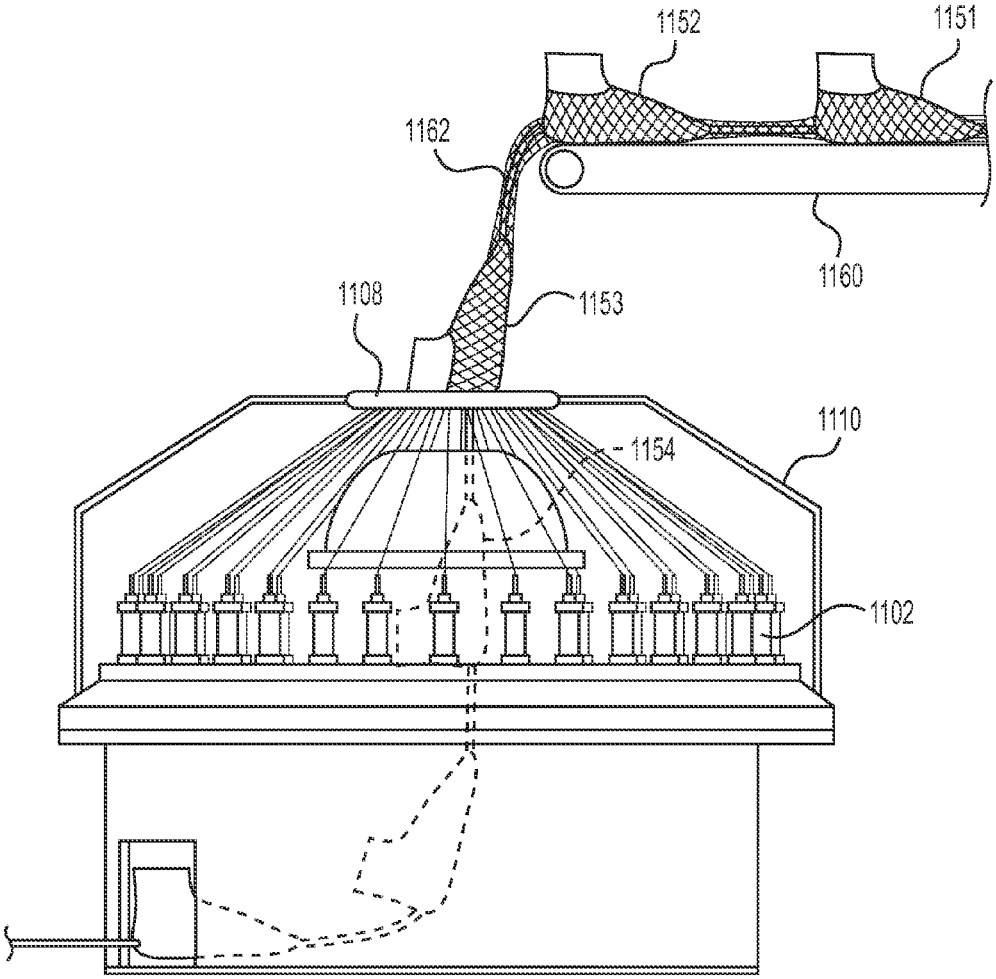

FIGS. 26-30 show an example of a braiding machine, such as one of the embodiments described above with respect to FIGS. 1-4, 7-20 and 22-25, as viewed from one end. These figures show forms 1151-1154 entering braiding machine 1100, and being pulled to and through ring 1108 by lead rope 1161. Lead rope 1161 is pulled up to and over conveyor 1160, so as to pull form 1151 onto conveyor 1160. Each of form 1151, form 1152, form 1153 and form 1154 is attached to its adjoining forms by a connecting rope portion 1162, such that all the forms are pulled along as form 1151 is pulled up. Ring 1108 is held in place by support 1110. In FIG. 26, form 1151, shown in phantom through enclosure 1112, is about to enter the braiding point above ring 1108. Form 1152, form 1153 and form 1154 are set to follow form 1151 through the braiding point above ring 1108. In FIG. 27, form 1151 is passing through ring 1108. Tensile elements 1120, unwinding from spools 1102, have been braided over a forefoot portion of form 1151. In FIG. 28, form 1151 has passed through the braiding point and is completely braided over, forming in this example an upper for an article of footwear. Form 1152 is approaching the braiding point above ring 1108. In FIG. 29, form 1151 is being pulled onto conveyor 1160, and most of form 1152 has passed through ring 1108 and has been braided over. Finally, in FIG. 30 form 1151 and form 1152 have been pulled onto conveyor 1160, and form 1153 has almost finished passing through ring 1108.

It may be appreciated that embodiments of the braiding machines disclosed herein may be used in forming various kinds of braided articles. For example, embodiments of the braid machines could be used to form uppers or related structures incorporated into various kinds of footwear including, but not limited to, basketball shoes, hiking boots, soccer shoes, football shoes, sneakers, running shoes, cross-training shoes, rugby shoes, baseball shoes as well as other kinds of shoes. Additionally, in some cases, articles with high cuffs, such as boots, could be formed using embodiments of the machines described here.

While various embodiments have been described in the detailed description above, the description is intended to be exemplary, rather than limiting, and it will be apparent to those of ordinary skill in the art that many more embodiments and implementations are possible. Accordingly, the scope of the claims is not to be restricted to the specific embodiments described herein. Also, various modifications and changes may be made within the scope of the attached claims.

What is claimed is:

1. A braiding machine, comprising:
- a plurality of rotor metals arranged along a rotor track comprising at least one curved portion and an outer perimeter; and
- a plurality of carriages disposed between the plurality of rotor metals along the rotor track,
- wherein, when at rest, a central axis of each rotor metal is oriented in a direction that is normal to a tangent of the outer perimeter of the rotor track,
- wherein, when at rest, a central axis of each carriage is oriented in a direction that is normal to a tangent of the outer perimeter of the rotor track,
- wherein, on the at least one curved portion of the rotor track, the orientation of the central axis of the carriages and the orientation of the central axis of the adjoining rotor metals are at an angle relative to each other,
- wherein a first rotor metal of the plurality of rotor metals has a first concave side for receiving a first carriage and a second concave side for receiving a second carriage, and
- wherein, as the first rotor metal rotates, a position of the first carriage along the rotor track is changed,
- wherein the rotor track comprises a first portion and a second portion, and
- wherein a radius of curvature of the second portion of the rotor track is greater than a radius of curvature of the first portion of the rotor track.

2. The braiding machine of claim 1, wherein the plurality of carriages are disposed at a plurality of positions around a perimeter of the braiding machine, and wherein any carriage may be transported from any position on the perimeter of the braiding machine to any other position on the perimeter of the braiding machine.

3. The braiding machine of claim 1, further comprising spools wound with tensile elements mounted respectively on the plurality of carriages, wherein the tensile elements extend from the spools to a ring located at a braid point of the braiding machine.

4. The braiding machine of claim 1, wherein the first portion is a first semi-circular portion and the second portion is a first linear portion.

5. The braiding machine of claim 4, further comprising a third portion and a fourth portion,
- wherein the third portion is a second semi-circular portion and the fourth portion is a second linear portion,
- wherein the second portion connects a first end of the first portion to a first end of the third portion, and
- wherein the fourth portion connects a second end of the first portion to a second end of the third portion.

6. The braiding machine of claim 1, wherein the plurality of rotor metals comprises at least 96 rotor metals.

7. The braiding machine of claim 1, wherein the plurality of rotor metals comprises at least 144 rotor metals.

8. The braiding machine of claim 1, further comprising a third portion, wherein the first portion is a quarter-circular corner portion and the third portion is a quarter-circular corner portion, and wherein the second portion connects a first end of the first portion to a first end of the third portion.

9. The braiding machine of claim 1, wherein the rotor track comprises at least one linear portion.

10. The braiding machine of claim 1, wherein the rotor track comprises at least one lobe portion.

11. A braiding machine, comprising:

a rotor track comprising at least one curved portion and an outer perimeter;

a plurality of rotor metals disposed on the rotor track; and a plurality of carriages disposed on the rotor track and positioned between the plurality of rotor metals, wherein, when at rest, a central axis of each rotor metal is oriented in a direction that is normal to a tangent of the outer perimeter of the rotor track, wherein, when at rest, a central axis of each carriage is oriented in a direction that is normal to a tangent of the outer perimeter of the rotor track, wherein, on the at least one curved portion of the rotor track, the orientation of the central axis of the carriages and the orientation of the central axis of the adjoining rotor metals are at an angle relative to each other, wherein the outer perimeter forms a simple closed curve that encloses an area; and wherein the area enclosed by the outer perimeter of the rotor track is less than an area enclosed by a circle whose circumference is equal to a length of the outer perimeter of the simple closed curve.

12. The braiding machine of claim 11, wherein the simple closed curve is a convex simple closed curve.

13. The braiding machine of claim 11, wherein the simple closed curve comprises one or more concave portions.

14. The braiding machine of claim 11, wherein the simple closed curve comprises at least one linear portion.

15. The braiding machine of claim 11, wherein the simple closed curve has a racetrack geometry.

16. The braiding machine of claim 11, wherein the plurality of rotor metals comprises at least 96 rotor metals.

17. The braiding machine of claim 11, wherein the plurality of rotor metals comprises at least 144 rotor metals.

18. A braiding machine, comprising:

a rotor track with at least one curved portion, the rotor track having an inner perimeter that forms a simple closed curve and an outer perimeter;

a plurality of rotor metals arranged along the rotor track;

a plurality of carriages disposed on the rotor track and adjoining the plurality of rotor metals;

a plurality of spools mounted respectively on the plurality of carriages;

a plurality of tensile elements, wherein each tensile element extends from one of the plurality of spools to a braid point within the simple closed curve formed by the inner perimeter of the rotor track, wherein, when at rest, a central axis of each rotor metal is oriented in a direction that is normal to a tangent of the outer perimeter of the rotor track, wherein, when at rest, a central axis of each carriage is oriented in a direction that is normal to a tangent of the outer perimeter of the rotor track, wherein, on the at least one curved portion of the rotor track, the orientation of the central axis of a first carriage of the plurality of carriages and the orientation of the central axis of a first rotor metal of the plurality of rotor metals positioned adjacent the first carriage are at an angle relative to each other, wherein a longest distance from each of the plurality of spools to the braid point is greater than a shortest distance from each of the plurality of spools to the braid point.

19. The braiding machine of claim 18, wherein each one of the plurality of rotor metals comprises a first concave side and a second concave side, and wherein each rotor metal of the plurality of rotor metals has a carriage adjacent its first concave side and a carriage adjacent its second concave side on the rotor track.

20. The braiding machine of claim 18, wherein each of the plurality of rotor metals may be rotated in both a first rotation direction and in a second rotation direction.

21. The braiding machine of claim 18, wherein the braid point is positioned at a geometric center of the simple closed curve.

22. The braiding machine of claim 18, wherein the simple closed curve is an oval.

23. The braiding machine of claim 18, wherein the simple closed curve comprises a first semi-circular end portion, a second semi-circular end portion, a first linear portion connecting a first end of the first semi-circular end portion to a first end of the second semi-circular end portion, and a second linear portion connecting a second end of the first semi-circular end portion to a second end of the second semi-circular end portion.

24. The braiding machine of claim 18, wherein the plurality of rotor metals comprises at least 96 rotor metals.

25. The braiding machine of claim 18, wherein the plurality of rotor metals comprises at least 14 rotor metals.

26. The braiding machine of claim 18, wherein the plurality of rotor metals comprises between 14 and 28 rotor metals, inclusive.

27. The braiding machine of claim 18, wherein the longest distance from each of the plurality of spools to the braid point is at least 30% greater than the shortest distance from each of the plurality of spools to the braid point.

* * * * *